US011242217B1

(12) United States Patent
Leger et al.

(10) Patent No.: US 11,242,217 B1
(45) Date of Patent: Feb. 8, 2022

(54) PIPE SPOOLING DEPLOYMENT EQUIPMENT SYSTEMS AND METHODS

(71) Applicant: Trinity Bay Equipment Holdings, LLC, Houston, TX (US)

(72) Inventors: John Paul Leger, Baytown, TX (US); Todd Steven Savoie, Humble, TX (US); Ashesh Srivastava, Houston, TX (US)

(73) Assignee: Trinity Bay Equipment Holdings, LLC, Houston, TX (US)

( * ) Notice: Subject to any disclaimer, the term of this patent is extended or adjusted under 35 U.S.C. 154(b) by 0 days.

(21) Appl. No.: 17/329,429

(22) Filed: May 25, 2021

Related U.S. Application Data

(60) Provisional application No. 63/052,741, filed on Jul. 16, 2020.

(51) Int. Cl.
*B65H 75/30* (2006.01)
*B65H 75/24* (2006.01)
*E21B 19/00* (2006.01)

(52) U.S. Cl.
CPC ..... *B65H 75/30* (2013.01); *B65H 75/24* (2013.01); *E21B 19/008* (2013.01); *B65H 2402/42* (2013.01); *B65H 2403/93* (2013.01); *B65H 2406/40* (2013.01)

(58) Field of Classification Search
CPC ..... B65H 49/32; B65H 59/04; B65H 49/325; B65H 75/425; B65H 75/4478; B65H 75/4442; B65H 75/30; B65H 75/24; B65H 2402/42; B65H 2403/93; B65H 2406/40
See application file for complete search history.

(56) References Cited

U.S. PATENT DOCUMENTS 3,482,607 A * 12/1969 Villani ..... D03D 49/06 139/304
4,325,522 A * 4/1982 Sauber ..... B65H 49/32 188/72.9
4,447,012 A * 5/1984 Woodruff ..... B65H 16/06 242/423.1

(Continued)

OTHER PUBLICATIONS

Jim Smith, Economic Alternatives for Deploying Subsea Cables, Subsea Expo 2015, Feb. 11, 2015.

(Continued)

*Primary Examiner* — William A. Rivera
(74) *Attorney, Agent, or Firm* — Conrad J. Hsu

(57) ABSTRACT

Techniques for implementing and/or operating a system that includes a pipe drum, which has a drum shaft and a drum body that enables a pipe segment to be spooled on the pipe drum, and pipe deployment equipment. The pipe deployment equipment includes a brake disc, which has a shaft socket that is keyed to matingly interlock with the drum shaft to facilitate tying rotation of the pipe drum with rotation of the brake disc, and a spooling assembly that includes a motor shaft, in which the spooling assembly ties rotation of the motor shaft with the rotation of the brake disc to enable the pipe deployment equipment to actively rotate the brake disc in a first direction to facilitate spooling the pipe segment off of the pipe drum, to actively rotate the brake disc in a second direction to facilitate spooling the pipe segment onto the pipe drum, or both.

17 Claims, 10 Drawing Sheets

(56) References Cited

U.S. PATENT DOCUMENTS

| | | | | |
|---|---|---|---|---|
| 5,211,203 | A * | 5/1993 | Vollweiler | B65H 75/425 134/151 |
| 5,366,171 | A * | 11/1994 | Kononov | B60P 3/035 242/422.2 |
| 9,206,658 | B1 * | 12/2015 | Dion | E21B 19/22 |
| 2013/0168484 | A1 * | 7/2013 | Novotny | B65H 59/18 242/419.8 |
| 2013/0341455 | A1 * | 12/2013 | Worton | B65H 49/32 242/557 |
| 2015/0166297 | A1 * | 6/2015 | Smith | B65H 49/38 242/557 |
| 2018/0118505 | A1 * | 5/2018 | Prince | B65H 75/4421 |
| 2018/0282109 | A1 * | 10/2018 | Colleoni | H02G 11/02 |
| 2020/0339380 | A1 * | 10/2020 | Dion | B65H 75/4484 |

OTHER PUBLICATIONS https://maritimedevelopments.com/products/reel-drive-systems, Reel Drive System, Mar. 27, 2020.

https://venturahydraulics.com/products/cable-line-spoolers/, Cable Line Spoolers, Mar. 27, 2020.

* cited by examiner

PIPE SPOOLING DEPLOYMENT EQUIPMENT SYSTEMS AND METHODS

CROSS-REFERENCE

The present disclosure claims priority to and benefit of U.S. Provisional Patent Application No. 63/052,741, entitled "PIPE SPOOLING DEPLOYMENT EQUIPMENT SYSTEMS AND METHODS" and filed Jul. 16, 2020, which is incorporated herein by reference in its entirety for all purposes.

BACKGROUND

The present disclosure generally relates to pipeline systems and, more particularly, to pipe deployment equipment that may be implemented and/or operated to deploy (e.g., lay) one or more pipe segments in a pipeline system.

Pipeline systems are often implemented and/or operated to transport (e.g., convey) fluid, such as liquid and/or gas, from a fluid source to a fluid destination. For example, a pipeline system may be used to transport one or more hydrocarbons, such as crude oil, petroleum, natural gas, or any combination thereof. Additionally or alternatively, a pipeline system may be used to transport one or more other types of fluid, such as produced water, fresh water, fracturing fluid, flowback fluid, carbon dioxide, or any combination thereof.

To facilitate transporting fluid, a pipeline system may include one or more pipe segments in addition to one or more pipe (e.g., midline and/or end) fittings, for example, which are used to connect a pipe segment to another pipeline component, such as another pipe fitting, another pipe segment, a fluid source, and/or a fluid destination. Generally, a pipe segment includes tubing, which defines (e.g., encloses) a pipe bore that provides a primary fluid conveyance (e.g., flow) path through the pipe segment. More specifically, the tubing of a pipe segment may be implemented to facilitate isolating (e.g., insulating) fluid being conveyed within its pipe bore from environmental conditions external to the pipe segment, for example, to reduce the likelihood of the conveyed (e.g., bore) fluid being lost to the external environmental conditions and/or the external environmental conditions contaminating the conveyed fluid (e.g., clean and/or potable water).

Additionally, in some instances, a pipe segment to be deployed in a pipeline system may be flexible and, thus, spooled (e.g., coiled, wrapped, and/or wound) on a pipe drum. Furthermore, in some instances, pipe deployment equipment, such as a pipe deployment trailer, may be implemented and/or operated to facilitate deploying (e.g., laying) a pipe segment spooled on a pipe drum into a pipeline system, for example, at least in part by unspooling (e.g., unwrapping and/or unwinding) the pipe segment from the pipe drum. However, a pipe segment to be deployed in a pipeline system may often be spooled onto a pipe drum using pipe spooling equipment that is separate from pipe deployment equipment that is to be used to deploy the pipe segment in the pipeline system, which, at least in some instances, may potentially limit deployment efficiency of the pipeline system, for example, due to the pipe drum having to be transferred between the pipe spooling equipment and the pipe deployment equipment.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one embodiment, a system includes a pipe drum, in which the pipe drum includes a drum shaft and a drum body that enables a pipe segment including tubing that defines a pipe bore and a fluid conduit within an annulus of the tubing to be spooled on the pipe drum, and pipe deployment equipment on which the pipe drum is to be loaded. The pipe deployment equipment includes a brake disc, in which the brake disc includes a shaft socket that is keyed to matingly interlock with the drum shaft of the pipe drum to facilitate tying rotation of the pipe drum with rotation of the brake disc, and a spooling assembly that includes a motor with a motor shaft, in which the spooling assembly ties rotation of the motor shaft with the rotation of the brake disc to enable the pipe deployment equipment to actively rotate the brake disc in a first direction to facilitate spooling the pipe segment off of the pipe drum, to actively rotate the brake disc in a second direction to facilitate spooling the pipe segment onto the pipe drum, or both.

In another embodiment, a method of operating pipe deployment equipment in a pipe deployment system includes determining, using a control sub-system of the pipe deployment system, a target operation to be performed by the pipe deployment equipment, in which a pipe drum and a pipe segment spooled on the pipe drum are loaded on the pipe deployment equipment; instructing, using the control sub-system, a braking assembly of the pipe deployment equipment to actuate a brake pad against a brake disc that is matingly interlocked with the pipe drum to facilitate slowing deployment of the pipe segment from the pipe deployment equipment in response to determining that the target operation to be performed by the pipe deployment equipment is a braking operation; and instructing, using the control sub-system, a power sub-system in the pipe deployment system to supply power to a spooling assembly of the pipe deployment equipment to enable the pipe deployment equipment to actively rotate the brake disc of the braking assembly to facilitate spooling the pipe segment onto the pipe drum that is matingly interlocked with the brake disc, off of the pipe drum that is matingly interlocked with the brake disc, or both in response to determining that the target operation to be performed by the pipe deployment equipment is a pipe spooling operation.

In another embodiment, a pipe deployment system includes a pipe deployment trailer. The pipe deployment trailer includes an equipment frame; one or more wheels secured to the equipment frame to enable the pipe deployment trailer to be moved by a vehicle in the pipe deployment system; a braking assembly secured to the equipment frame, in which the braking assembly includes a brake disc that matingly interlocks with a pipe drum that is to be loaded on the pipe deployment trailer to facilitate tying rotation of the brake disc with rotation of the pipe drum; and a spooling assembly including a motor. The spooling assembly ties rotation of a motor shaft of the motor to the rotation of the brake disc in the braking assembly to enable the pipe deployment trailer to actively rotate the brake disc in a first direction to facilitate spooling a pipe segment off of the pipe drum that is matingly interlocked with the brake disc; actively rotate the brake disc in a second direction to facilitate spooling the pipe segment onto the pipe drum that is matingly interlocked with the brake disc; or both.

DETAILED DESCRIPTION

Figure 1:
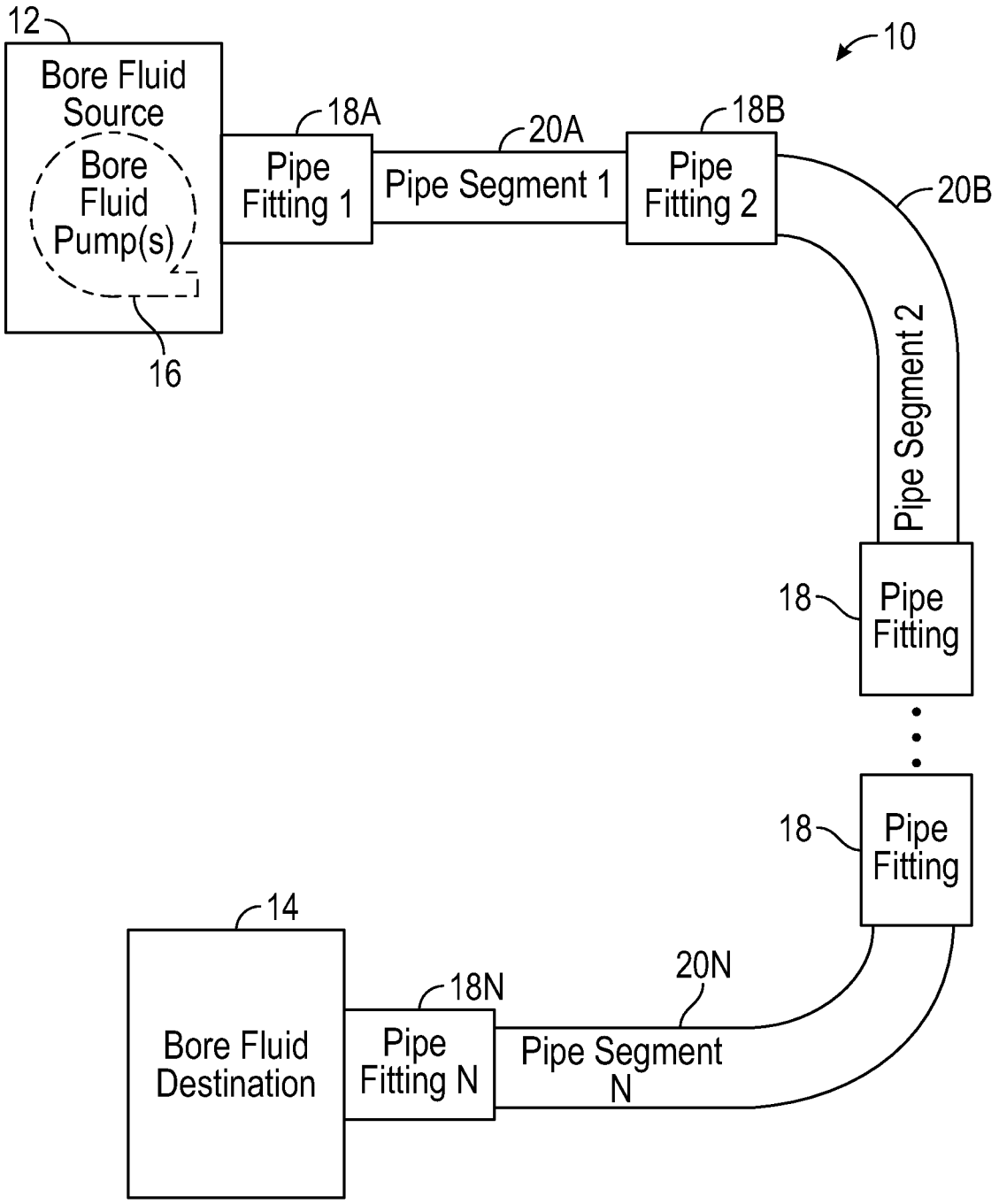
FIG. 1 is a block diagram of an example of a pipeline system including pipe segments and pipe fittings, in accordance with an embodiment of the present disclosure.

One or more specific embodiments of the present disclosure will be described below with reference to the figures. As used herein, the term "coupled" or "coupled to" may indicate establishing either a direct or indirect connection and, thus, is not limited to either unless expressly referenced as such. The term "set" may refer to one or more items. Wherever possible, like or identical reference numerals are used in the figures to identify common or the same features. The figures are not necessarily to scale. In particular, certain features and/or certain views of the figures may be shown exaggerated in scale for purposes of clarification.

The present disclosure generally relates to pipeline systems that may be implemented and/or operated to transport (e.g., convey) fluid, such as liquid and/or gas, from a fluid source to a fluid destination. Generally, a pipeline system may include pipe fittings, such as a midline pipe fitting and/or a pipe end fitting, and one or more pipe segments. More specifically, a pipe segment may generally be secured and sealed in one or more pipe fittings to facilitate fluidly coupling the pipe segment to another pipeline component, such as another pipe segment, another pipe fitting, a fluid source, and/or a fluid destination. Merely as an illustrative non-limiting example, a pipeline system may include a first pipe end fitting secured to a first pipe segment to facilitate fluidly coupling the first pipe segment to the fluid source, a midline pipe fitting secured between the first pipe segment and a second pipe segment to facilitate fluidly coupling the first pipe segment to the second pipe segment, and a second pipe end fitting secured to the second pipe segment to facilitate fluidly coupling the second pipe segment to the fluid destination.

In any case, a pipe segment generally includes tubing that defines (e.g., encloses) a pipe bore, which provides a primary fluid conveyance (e.g., flow) path through the pipe segment. More specifically, the tubing of a pipe segment may be implemented to facilitate isolating environmental conditions external to the pipe segment from conditions within its pipe bore and, thus, fluid that flows therethrough. In particular, the tubing of a pipe segment may primarily be implemented to block fluid flow directly between the pipe bore of the pipe segment and its external environmental conditions, for example, in addition to providing thermal, pressure, and/or electrical isolation (e.g., insulation).

Furthermore, in some instances, a pipe segment may be flexible. In fact, in some such instances, the pipe segment may be spooled (e.g., coiled, wrapped, and/or wound) on a pipe drum, for example, which is implemented along with reel ends in a pipe reel or as an independent pipe drum. Additionally, in some such instances, the pipe segment may be deployed (e.g., laid) from the pipe drum into a pipeline system using pipe deployment equipment, such as a pipe deployment trailer or a pipe deployment frame. In particular, in such instances, the pipe drum along with the pipe segment may be loaded onto the pipe deployment equipment and the pipe segment may then be deployed therefrom into the pipeline system at least in part by unspooling (e.g., unwrapping and/or unwinding) the pipe segment from the pipe drum, for example, passively by pulling on a free end of the pipe segment.

To facilitate controlling pipe deployment speed, pipe deployment equipment may include a braking assembly, which has a brake disc and one or more brake pads implemented proximate to the brake disc. In particular, in some instances, the brake disc may include a shaft socket, which is keyed to matingly interface with a corresponding keyed shaft to facilitate tying rotation of the brake disc to rotation of the keyed shaft. For example, the shaft socket of the braking assembly may be keyed to include one or more flat inner surfaces. Thus, to facilitate tying its rotation to the rotation of the brake disc, a pipe drum may include a drum shaft that extends out from its drum body on which one or more pipe segments are wrapped (e.g., coiled) and that is keyed with one or more corresponding flat outer surfaces.

However, a pipe segment to be deployed in a pipeline system may often be spooled onto a pipe drum using pipe spooling equipment. In particular, the pipe spooling equipment is generally separate from and independent of pipe deployment equipment to be used to deploy the pipe segment in a pipeline system. In other words, in such instances, to deploy a pipe segment in a pipeline system, a pipe drum on which the pipe segment is spooled may have to be transferred between the pipe spooling equipment and the pipe deployment equipment (e.g., using a crane), thereby potentially limiting deployment efficiency of the pipeline system.

Accordingly, to facilitate improving pipeline deployment efficiency, the present disclosure provides techniques for implementing and/or operating pipe deployment equipment, such as a pipe deployment trailer and/or or a pipe deployment frame, in a pipe deployment system to facilitate deploying one or more pipe segments in a pipeline system as well as actively spooling (e.g., unspooling and/or respooling) the one or more pipe segments onto and/or off of a corresponding pipe drum. To facilitate spooling a pipe segment, as will be described in more detail below, the pipe deployment equipment may include a spooling assembly in addition to its braking assembly. Furthermore, as will be described in more detail below, in addition to pipe deployment equipment, the pipe deployment system may include a power sub-system, which power operations of the pipe deployment equipment and/or a separate pipe handler, and a control sub-system, which generally controls operation of the pipe deployment system.

In other words, in some embodiments, the control sub-system in a pipe deployment system may generally control operation of the pipe deployment system to actively spool one or more pipe segments onto and/or off of a corresponding pipe drum. Generally, a pipe segment may be unspooled (e.g., unwrapped and/or unwound) off of a pipe drum at least in part by rotating the pipe drum in a first direction. On the other hand, the pipe segment may generally be spooled (e.g., respooled, wrapped, and/or wound) onto the pipe drum at least in part by rotating the pipe drum in a second (e.g., opposite) direction. In other words, to facilitate spooling a pipe segment using pipe deployment equipment, the spooling assembly of the pipe deployment equipment may generally be implemented and/or operated to enable controlling rotational direction of a corresponding pipe drum, for example, in addition to rotational speed of the pipe drum.

To facilitate controlling rotational direction of a pipe drum, in some embodiments, the spooling assembly on pipe deployment equipment may include one or more motors, such as a hydraulic motor, a pneumatic motor, and/or an electric motor. In fact, since its rotation is to be tied with rotation of a corresponding pipe drum, to facilitate reducing component count and, thus, implementation associated cost of the pipe deployment equipment, in some embodiments, the spooling assembly may be implemented and/or operated to utilize the brake disc in the braking assembly of the pipe deployment equipment. In particular, in such embodiments, to facilitate controlling pipe drum rotation, the spooling assembly may be implemented to tie rotation of a motor shaft therein to rotation of the brake disc and, thus, rotation of a pipe drum that is secured to the brake disc. Merely as an illustrative non-limiting example, in some such embodiments, the motor shaft in the spooling assembly may be secured (e.g., welded and/or bolted) directly to an outward-facing surface of the brake disc, for example, when a keyed shaft socket is implemented on an inward-facing (e.g., opposite) surface of the brake disc.

However, in other embodiments, a spooling assembly on pipe deployment equipment in a pipe deployment system may not include a motor. Instead, in some such embodiments, one or more motors in the pipe deployment system that drive operation of the spooling assembly may be separate (e.g., external) from the pipe deployment equipment and, thus, the spooling assembly. For example, the one or more motors may be included in a pipe handler that is attached to an excavator or a crane. Moreover, as will be described in more detail below, in other such embodiments, the pipe deployment equipment may be implemented to drive operation of its spooling assembly using rotation of a wheel (e.g., trailer) axle, for example, to enable the spooling assembly to operate as the pipe deployment equipment is being moved (e.g., towed).

In any case, to facilitate improving control over pipe drum rotational speed and, thus, spooling speed provided by pipe deployment equipment in a pipe deployment system, in some embodiments, the spooling assembly of the pipe deployment equipment may include a gear box, such as a planetary gear box, that is to be connected between one or more of motors and a brake disc in the braking assembly of the pipe deployment equipment. In particular, to facilitate controlling pipe drum rotation, in such embodiments, rotation of a motor shaft of a motor may be tied to rotation of an input (e.g., drive) wheel (e.g., gear) of the gear box and rotation of an output (e.g., driven) wheel (e.g., gear and/or sprocket) of the gear box may be tied to rotation of the brake disc and, thus, rotation of a pipe drum that is secured to brake disc. Merely as an illustrative non-limiting example, in some such embodiments, the output wheel of the gear box may be secured (e.g., welded and/or bolted) directly to an outward-facing surface of the brake disc, for example, when a keyed shaft socket is implemented on an inward-facing (e.g., opposite) surface of the brake disc.

However, in some embodiments, pipe deployment equipment may be implemented to enable a brake disc in its braking assembly to move position (e.g., location) slightly (e.g., a few inches), for example, to facilitate easing the loading of a pipe drum thereon at least in part by enabling a keyed shaft socket on the brake disc to be moved into alignment with a corresponding keyed drum shaft of the pipe drum without moving the pipe deployment equipment as a whole. To enable translational movement of the brake disc, in such embodiments, a motor shaft and/or an output gear of a gear box may not be directly secured to the brake disc. Instead, in such embodiments, the motor shaft and/or the output gear of the gear box may be connected to a disc wheel (e.g., gear and/or sprocket) that is implemented on an outward-facing surface of the brake disc, for example, when a keyed shaft socket is implemented on an inward-facing (e.g., opposite) surface of the brake disc.

To facilitate enabling more translational brake disc movement, in some embodiments, a spooling assembly of pipe deployment equipment in a pipe deployment system may additionally include a looped member, such as a chain or a belt. For example, in some such embodiments, the looped member may be connected around the output wheel (e.g., gear) of a gear box in the spooling assembly and a brake disc wheel (e.g., gear and/or sprocket) that is secured to a brake disc in the braking assembly of the pipe deployment equipment. In other such embodiments, the looped member may be connected around a motor shaft and a brake disc wheel that is secured to the brake disc in the braking assembly of the pipe deployment equipment. In any case, in this manner, rotation of the motor shaft may be tied to rotation of the brake disc and, thus, a pipe drum secured to the brake disc, thereby enabling the pipe deployment system to actively control at least rotational direction of the pipe drum and, thus, spooling (e.g., unspooling and/or respooling) of one or more pipe segment onto and/or off from the pipe drum.

However, as mentioned above, in some embodiments, the spooling assembly on pipe deployment equipment may additionally be implemented and/or operated to facilitate controlling rotational speed of a pipe drum and, thus, the speed with which a pipe segment is spooled onto and/or off of the pipe drum. In fact, in some such embodiments, the ability of the spooling assembly to control rotational speed of the pipe drum may obviate a brake pad in the braking assembly of the pipe deployment equipment and, thus, the pipe deployment equipment may not include the brake pad, which, at least in some instances, may facilitate reducing implementation associated cost of the pipe deployment equipment, for example, at least in part by reducing the component count of the pipe deployment equipment. In any case, as can be appreciated, rotating a pipe drum at a slower speed may potentially limit spooling efficiency. On the other hand, at least in some instances, rotating a pipe drum at a faster speed may produce tension in a corresponding pipe segment that inadvertently deforms the pipe segment and/or otherwise compromises structural integrity of the pipe segment.

To facilitate optimizing spooling efficiency (e.g., balancing spooling speed and likelihood of structural integrity being compromised), in some embodiments, a pipe deployment system may include one or more sensors communicatively coupled to its control sub-system. Generally, a sensor in the pipe deployment system may be implemented and/or operated to determine sensor data indicative of one or more operational parameters of pipe deployment equipment in the pipe deployment system. For example, a tension sensor may be implemented and/or operated to determine sensor data indicative of tension exerted on a pipe segment that is being spooled (e.g., unspooled and/or respooled) onto and/or off of a pipe drum by the pipe deployment equipment. Additionally or alternatively, a torque sensor may be implemented and/or operated to determine sensor data indicative of torque that is exerted on a pipe drum onto and/or off of which a pipe segment is being spooled, which may then be processed based at least in part on the diameter of a pipe coil that is formed by the portion of the pipe segment disposed around the drum body of the pipe drum to determine the tension exerted on the pipe segment. Furthermore, a velocity sensor may be implemented and/or operated to determine sensor data indicative of rotational speed and/or rotational direction of a pipe drum loaded on the pipe deployment equipment. In fact, in some such embodiments, the control sub-system may autonomously control operation of the pipe deployment system based at least in part on the sensor data determined by the one or more sensors, for example, with little or no user intervention.

In any case, in some embodiments, one or more of the sensors in a pipe deployment system may be deployed at a power sub-system in the pipe deployment system. For example, a pressure sensor deployed at the power sub-system may be implemented and/or operated to determine sensor data indicative of fluid pressure flowing between the power sub-system and a motor in the pipe deployment system. In fact, in some such embodiments, the fluid pressure flowing between the motor and the power sub-system may be indicative of tension exerted on a pipe segment that is being actively spooled by actuation of the motor. In other words, in such embodiments, the spooling speed of the spooling assembly in the pipe deployment equipment may be controlled based at least in part on the fluid pressure flowing between the power sub-system and the motor, which, at least in some instances, may facilitate optimizing spooling efficiency while obviating deployment of a separate tension sensor in the pipe deployment system. In this manner, as will be described in more detail below, the present disclosure provides techniques for implementing and/or operating pipe deployment equipment, such as a pipe deployment trailer or a pipe deployment frame, to facilitate deploying one or more pipe segments in a pipeline system as well as actively spooling (e.g., unspooling and/or respooling) the one or more pipe segments onto and/or off of a corresponding pipe drum, which, at least in some instances, may facilitate improving deployment efficiency of the pipeline system, for example, by obviating separate spooling equipment and, thus, thus transfer of the pipe drum between the spooling equipment and the pipe deployment equipment.

To help illustrate, an example of a pipeline system 10 is shown in FIG. 1. As in the depicted example, the pipeline system 10 may be coupled between a bore fluid source 12 and a bore fluid destination 14. Merely as an illustrative non-limiting example, the bore fluid source 12 may be a production well and the bore fluid destination 14 may be a fluid storage tank. In other instances, the bore fluid source 12 may be a first (e.g., lease facility) storage tank and the bore fluid destination 14 may be a second (e.g., refinery) storage tank.

In any case, the pipeline system 10 may generally be implemented and/or operated to facilitate transporting (e.g., conveying) fluid, such as gas and/or liquid, from the bore fluid source 12 to the bore fluid destination 14. In fact, in some embodiments, the pipeline system 10 may be used in many applications, including without limitation, both onshore and offshore oil and gas applications. For example, in such embodiments, the pipeline system 10 may be used to transport one or more hydrocarbons, such as crude oil, petroleum, natural gas, or any combination thereof. Additionally or alternatively, the pipeline system 10 may be used to transport one or more other types of fluid, such as produced water, fresh water, fracturing fluid, flowback fluid, carbon dioxide, or any combination thereof.

To facilitate flowing fluid to the bore fluid destination 14, in some embodiments, the bore fluid source 12 may include one or more bore fluid pumps 16 that are implemented and/or operated to inject (e.g., pump and/or supply) fluid from the bore fluid source 12 into a bore of the pipeline system 10. However, it should be appreciated that the depicted example is merely intended to be illustrative and not limiting. In particular, in other embodiments, one or more bore fluid pumps 16 may not be implemented at the bore fluid source 12, for example, when fluid flow through the bore of the pipeline system 10 is produced by gravity. Additionally or alternatively, in other embodiments, one or more bore fluid pumps 16 may be implemented in the pipeline system 10 and/or at the bore fluid destination 14.

To facilitate transporting fluid from the bore fluid source 12 to the bore fluid destination 14, as in the depicted example, a pipeline system 10 may include one or more pipe fittings 18 and one or more pipe segments 20. For example, the depicted pipeline system 10 includes a first pipe segment 20A, a second pipe segment 20B, and an Nth pipe segment 20N. Additionally, the depicted pipeline system 10 includes a first pipe (e.g., end) fitting 18A, which couples the bore fluid source 12 to the first pipe segment 20A, a second pipe (e.g., midline) fitting 18B, which couples the first pipe segment 20A to the second pipe segment 20B, and an Nth pipe (e.g., end) fitting 18N, which couples the Nth pipe segment 20N to the bore fluid destination 14.

However, it should again be appreciated that the depicted example is merely intended to be illustrative and not limiting. In particular, in other embodiments, a pipeline system 10 may include fewer than three (e.g., one or two) pipe segments 20 or more than three (e.g., four, five, or more) pipe segments 20. Additionally or alternatively, in other embodiments, a pipeline system 10 may include fewer than four (e.g., one, two, or three) pipe fittings 18 or more than four (e.g., five, six, or more) pipe fittings 18.

In any case, as described above, a pipe segment 20 generally includes tubing that may be used to convey (e.g., transfer and/or transport) water, gas, oil, and/or any other suitable type of fluid. The tubing of a pipe segment 20 may be made of any suitable type of material, such as plastic, metal, and/or a composite (e.g., fiber-reinforced composite) material. In fact, as will be described in more detail below, in some embodiments, the tubing of a pipe segment 20 may be implemented using multiple different layers. For example, the tubing of a pipe segment 20 may include a first high-density polyethylene (e.g., internal corrosion protection) layer, one or more reinforcement (e.g., steel strip) layers external to the first high-density polyethylene layer, and a second high-density polyethylene (e.g., external corrosion protection) layer external to the one or more reinforcement layers.

Additionally, as in the depicted example, one or more (e.g., second and/or Nth) pipe segments 20 in a pipeline system 10 may be curved. To facilitate implementing a curve in a pipe segment 20, in some embodiments, the pipe segment 20 may be flexible, for example, such that the pipe segment 20 is spoolable on a reel and/or in a coil (e.g., during transport and/or before deployment of the pipe segment 20). In other words, in some embodiments, one or more pipe segments 20 in the pipeline system 10 may be a flexible pipe, such as a bonded flexible pipe, an unbonded flexible pipe, a flexible composite pipe (FCP), a thermoplastic composite pipe (TCP), or a reinforced thermoplastic pipe (RTP). In fact, at least in some instances, increasing the flexibility of a pipe segment 20 may facilitate improving deployment efficiency of a pipeline system 10, for example, by obviating a curved (e.g., elbow) pipe fitting 18 and/or enabling the pipe segment 20 to be transported to the pipeline system 10, deployed in the pipeline system 10, or both using a tighter spool.

To facilitate improving pipe flexibility, in some embodiments, the tubing of a pipe segment 20 that defines (e.g., encloses) its pipe bore may include one or more openings devoid of solid material. In fact, in some embodiments, an opening in the tubing of a pipe segment 20 may run (e.g., span) the length of the pipe segment 20 and, thus, define (e.g., enclose) a fluid conduit in the annulus of the tubing, which is separate from the pipe bore. In other words, in such embodiments, fluid may flow through a pipe segment 20 via its pipe bore, a fluid conduit implemented within its tubing annulus, or both.

Figure 2:
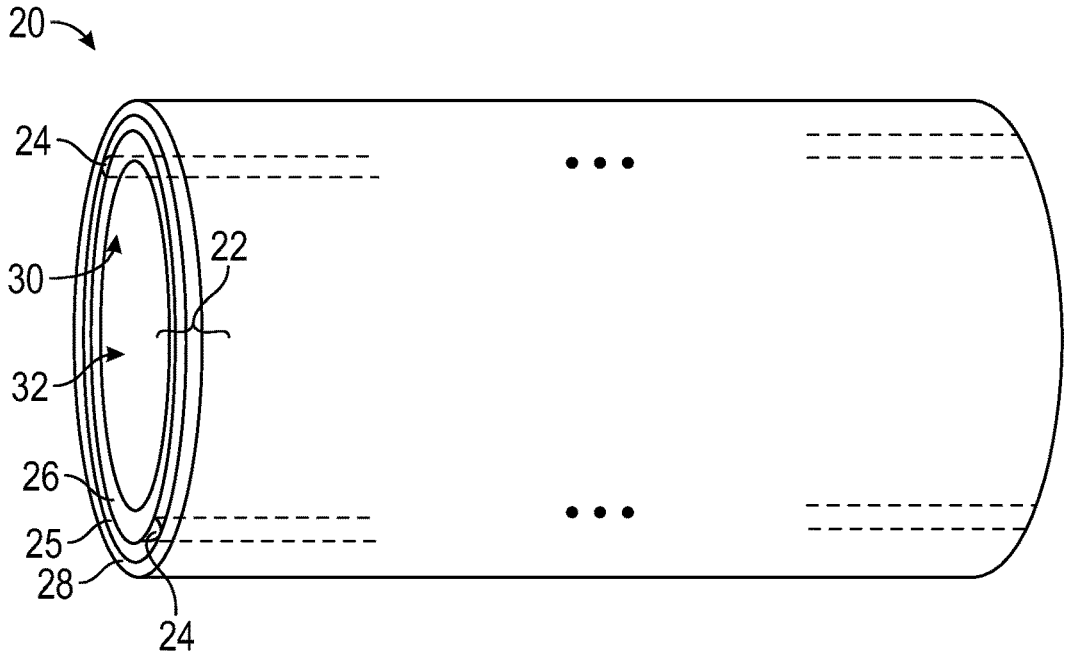
FIG. 2 is a side view of an example of a pipe segment of FIG. 1 that includes a pipe bore defined by its tubing as well as fluid conduits implemented within an annulus of its tubing, in accordance with an embodiment of the present disclosure.

To help illustrate, an example of a pipe segment 20, which includes tubing 22 with fluid conduits 24 implemented in a tubing annulus 25, is shown in FIG. 2. As depicted, the pipe segment tubing 22 is implemented with multiple layers including an inner barrier (e.g., liner and/or sheath) layer 26 and an outer barrier (e.g., shield and/or sheath) layer 28. In some embodiments, the inner barrier layer 26 and/or the outer barrier layer 28 of the pipe segment tubing 22 may be implemented using composite material and/or plastic, such as high-density polyethylene (HDPE), raised temperature polyethylene (PE-RT), cross-linked polyethylene (XLPE), polyamide 11 (PA-11), polyamide 12 (PA-12), polyvinylidene difluoride (PVDF), or any combination thereof. Although a number of particular layers are depicted, it should be understood that the techniques described in the present disclosure may be broadly applicable to composite pipe body structures including two or more layers, for example, as distinguished from a rubber or plastic single-layer hose subject to vulcanization. In any case, as depicted, an inner surface 30 of the inner barrier layer 26 defines (e.g., encloses) a pipe bore 32 through which fluid can flow, for example, to facilitate transporting fluid from a bore fluid source 12 to a bore fluid destination 14.

Additionally, as depicted, the annulus 25 of the pipe segment tubing 22 is implemented between its inner barrier layer 26 and its outer barrier layer 28. As will be described in more detail below, the tubing annulus 25 may include one or more intermediate layers of the pipe segment tubing 22. Furthermore, as depicted, fluid conduits 24 running along the length of the pipe segment 20 are defined (e.g., enclosed) in the tubing annulus 25. As described above, a fluid conduit 24 in the tubing annulus 25 may be devoid of solid material. As such, pipe segment tubing 22 that includes one or more fluid conduits 24 therein may include less solid material and, thus, exert less resistance to flexure, for example, as compared to solid pipe segment tubing 22 and/or pipe segment tubing 22 that does not include fluid conduits 24 implemented therein. Moreover, to facilitate further improving pipe flexibility, in some embodiments, one or more layers in the tubing 22 of a pipe segment 20 may be unbonded from one or more other layers in the tubing 22 and, thus, the pipe segment 20 may be an unbonded pipe.

However, it should be appreciated that the depicted example is merely intended to be illustrative and not limiting. In particular, in other embodiments, pipe segment tubing 22 may include fewer than two (e.g., one) or more than two (e.g., three, four, or more) fluid conduits 24 defined in its tubing annulus 25. Additionally or alternatively, in other embodiments, a fluid conduit 24 defined in a tubing annulus 25 of a pipe segment 20 may run non-parallel to the pipe bore 32 of the pipe segment 20, for example, such that the fluid conduit 24 is skewed relative to the longitudinal axis of the pipe bore 32.

Figure 3:
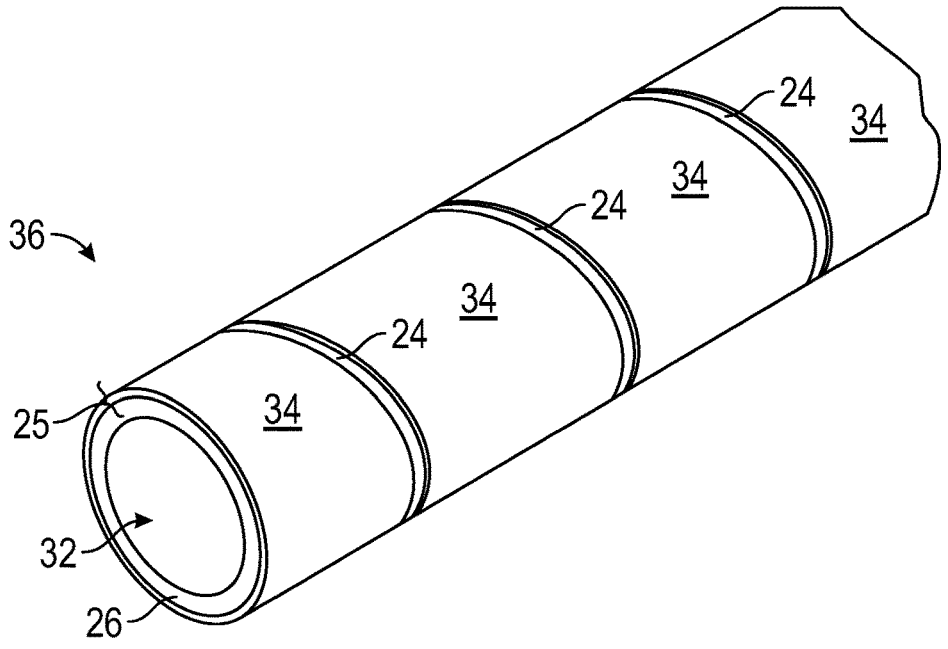
FIG. 3 is an example of a portion of the pipe segment of FIG. 2 with a helically shaped fluid conduit implemented within the annulus of its tubing, in accordance with an embodiment of the present disclosure.

To help illustrate, an example of a portion 36 of a pipe segment 20, which includes an inner barrier layer 26 and an intermediate layer 34 included in a tubing annulus 25 of its pipe segment tubing 22, is shown in FIG. 3. As depicted, the intermediate layer 34 is helically disposed (e.g., wound and/or wrapped) on the inner barrier layer 26 such that gaps (e.g., openings) are left between adjacent windings to define a fluid conduit 24. In other words, in some embodiments, the intermediate layer 34 may be implemented at least in part by winding a solid strip of material around the inner barrier layer 26 at a non-zero lay angle (e.g., fifty-four degrees)

relative to the longitudinal axis of the pipe bore 32. In any case, as depicted, the resulting fluid conduit 24 runs helically along the pipe segment 20, for example, such that the fluid conduit 24 is skewed fifty-four degrees relative to the longitudinal axis of the pipe bore 32.

In some embodiments, an outer barrier layer 28 may be disposed directly over the depicted intermediate layer 34 and, thus, cover and/or define (e.g., enclose) the depicted fluid conduit 24. However, in other embodiments, the tubing annulus 25 of pipe segment tubing 22 may include multiple (e.g., two, three, four, or more) intermediate layers 34. In other words, in such embodiments, one or more other intermediate layers 34 may be disposed over the depicted intermediate layer 34. In fact, in some such embodiments, the one or more other intermediate layers 34 may also each be helically disposed such that gaps are left between adjacent windings to implement one or more corresponding fluid conduits 24 in the pipe segment tubing 22.

For example, a first other intermediate layer 34 may be helically disposed on the depicted intermediate layer 34 using the same non-zero lay angle as the depicted intermediate layer 34 to cover (e.g., define and/or enclose) the depicted fluid conduit 24 and to implement another fluid conduit 24 in the first other intermediate layer 34. Additionally, a second other intermediate layer 34 may be helically disposed on the first other intermediate layer 34 using another non-zero lay angle, which is the inverse of the non-zero lay angle of the depicted intermediate layer 34, to implement another fluid conduit 24 in the second other intermediate layer 34. Furthermore, a third other intermediate layer 34 may be helically disposed on the second other intermediate layer 34 using the same non-zero lay angle as the second other intermediate layer 34 to cover the other fluid conduit 24 in the second other intermediate layer 34 and to implement another fluid conduit 24 in the third other intermediate layer 34. In some embodiments, an outer barrier layer 28 may be disposed over the third other intermediate layer 34 and, thus, cover (e.g., define and/or enclose) the other fluid conduit 24 in the third other intermediate layer 34. In any case, as described above, in some instances, one or more pipe segments 20 may be deployed in a pipeline system 10 a pipe deployment system.

Figure 4:
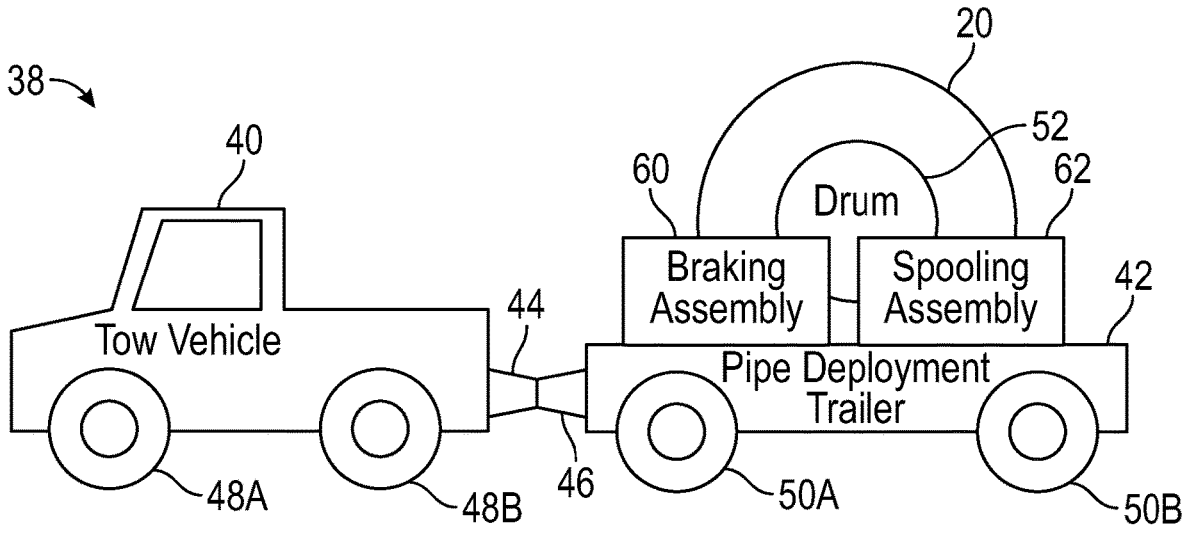
FIG. 4 is a side view of an example of a pipe deployment system that includes pipe deployment equipment—namely a pipe deployment trailer—loaded with one or more pipe segments spooled on a pipe drum, in accordance with an embodiment of the present disclosure.

To help illustrate, an example of a pipe deployment system 38 is shown in FIG. 4. As depicted, the pipe deployment system 38 includes a tow vehicle 40 and pipe deployment equipment—namely a pipe deployment trailer 42. In particular, as depicted, the tow vehicle 40 and the pipe deployment trailer 42 are coupled together via a hitch assembly 44 on the tow vehicle 40 and a tongue assembly 46 of the pipe deployment trailer 42.

However, it should be appreciated that the depicted example is merely intended to be illustrative and not limiting. In particular, as will be described in more detail below, a pipe deployment system 38 may additionally or alternatively include other types of pipe deployment equipment, such as a pipe deployment frame. Furthermore, as will be described in more detail below, a pipe deployment system 38 may additionally include other types of equipment, such as an excavator or a crane, and a pipe handler, which may be secured (e.g., attached) to equipment, such as an excavator or a crane.

In any case, as in the depicted example, a tow vehicle 40 in a pipe deployment system 38 may include one or more vehicle wheels 48. In particular, in the depicted example, the tow vehicle 40 includes a first vehicle wheel 48A and a second vehicle wheel 48B. However, it should again be appreciated that the depicted example is merely intended to be illustrative and not limiting. In particular, the tow vehicle 40 may additionally include a third vehicle wheel 48 opposite the first vehicle wheel 48A and a fourth vehicle wheel 48 opposite the second vehicle wheel 48B. Additionally or alternatively, in other embodiments, one or more vehicle wheels 48 may instead be implemented as part of a vehicle track assembly. Furthermore, in other embodiments, a pipe deployment system 38 may not include a separate tow vehicle 40, for example, when pipe deployment equipment, such as a pipe deployment trailer 42, is implemented to be self-propelled.

Similarly, as in the depicted example, the pipe deployment trailer 42 may include one or more trailer wheels 50. In particular, in the depicted example, the pipe deployment trailer 42 includes a first trailer wheel 50A and a second trailer wheel 50B. However, it should again be appreciated that the depicted example is merely intended to be illustrative and not limiting. For example, the pipe deployment trailer 42 may additionally include a third trailer wheel 50 opposite the first trailer wheel 50A and a fourth trailer wheel 50 opposite the second trailer wheel 50B. In any case, as depicted, a pipe drum 52 and one or more pipe segments 20 spooled (e.g., wrapped and/or wound) thereon are loaded on the pipe deployment trailer 42.

Figure 5:
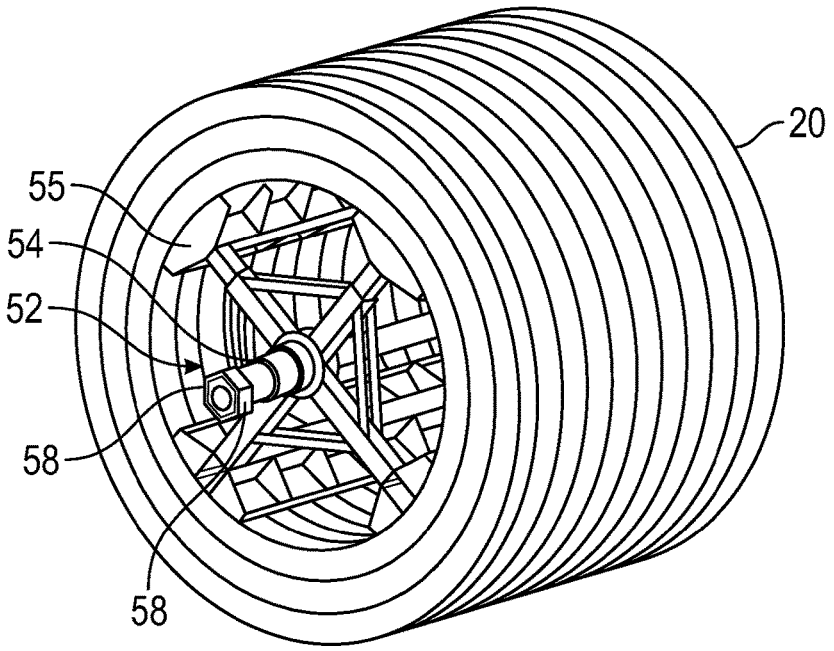
FIG. 5 is a perspective view of an example of a pipe segment spooled on the pipe drum of FIG. 4, in accordance with an embodiment of the present disclosure.

To help illustrate, an example of a pipe segment 20 spooled on a pipe drum 52 is shown in FIG. 5. As depicted, the pipe drum 52 includes a drum shaft 54 that extends out from its drum body 55 on which the pipe segment 20 is spooled (e.g., coiled, wrapped, and/or wound). In particular, as in the depicted example, the drum shaft 54 may be keyed with one or more flat outer surfaces 58, for example, to facilitate matingly interlocking (e.g., engaging and/or interfacing) the drum shaft 54 with a corresponding shaft socket that is keyed one or more flat inner surfaces and, thus, tying their rotations together.

However, it should be appreciated that the depicted example is merely intended to be illustrative and not limiting. In particular, in other embodiments, a drum shaft 54 of a pipe drum 52 may be keyed with a single flat outer surface 58 or more than two flat outer surfaces 58. Additionally or alternatively, in other embodiments, a pipe drum 52 may be implemented as part of a pipe reel, for example, which includes reel ends on either side of its drum body 55.

In any case, returning to FIG. 4, to facilitate controlling deployment of one or more pipe segments 20 from the pipe drum 52, as depicted, the pipe deployment trailer 42 additionally includes a braking assembly 60 and a spooling assembly 62. As will be described in more detail below, the braking assembly 60 may generally be implemented and/or operated to facilitate slowing or stopping rotation of the pipe drum 52, for example, to facilitate slowing or stopping deployment of one or more pipe segments 20 from the pipe deployment trailer 42 on which the pipe drum 52 is loaded. On the other hand, the spooling assembly 62 may generally be implemented and/or operated to facilitate actively spooling (e.g., unspooling and/or respooling) one or more pipe segments 20 onto and/or off of a pipe drum 52 that is loaded on the pipe deployment trailer 42.

Figure 6:
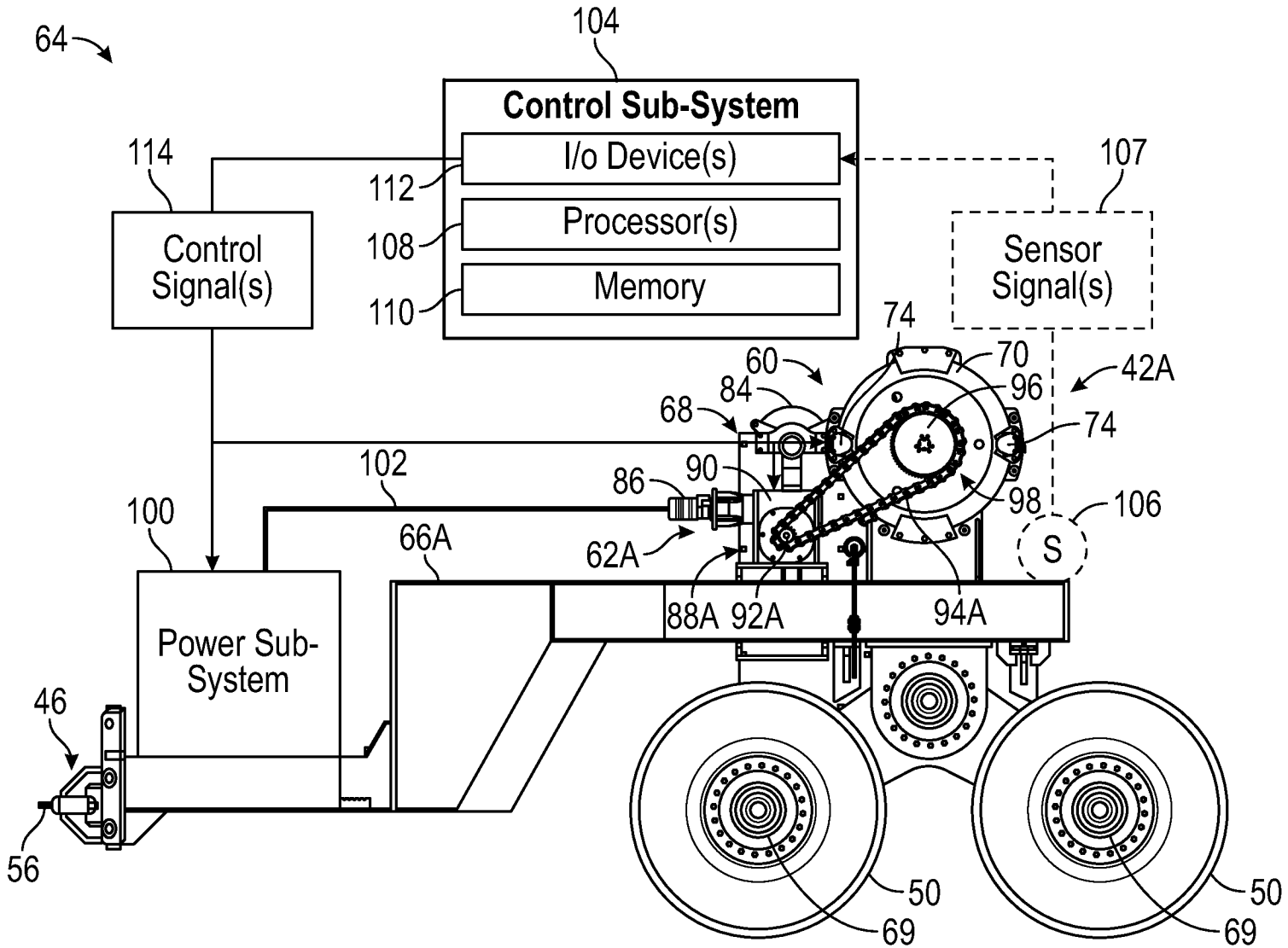
FIG. 6 is side view of an example of the pipe deployment trailer of FIG. 4 with a braking assembly and a spooling assembly, in accordance with an embodiment of the present disclosure.

To help illustrate, an example of a portion 64A of a pipe deployment system 38 that includes a pipe deployment trailer 42A is shown in FIG. 6. As depicted, the pipe deployment trailer 42A includes an equipment frame 66A as well as a tongue assembly 46, trailer wheels 50, a braking assembly 60, a spooling assembly 62A, and a lifting assembly 68, which are each secured to the equipment frame 66A. In particular, as depicted, the trailer wheels 50 are each rotatably secured to the equipment frame 66A via a corresponding trailer axle 69. Additionally, as depicted, the tongue assembly 46 includes a trailer coupler 56, which is implemented to be coupled to a trailer hitch in a corresponding hitch assembly 44. Furthermore, as depicted, the brake assembly 60 includes a brake disc 70, which may be implemented to have its rotation tied with the rotation of a pipe drum 52 loaded on the pipe deployment trailer 42A.

Figure 7:
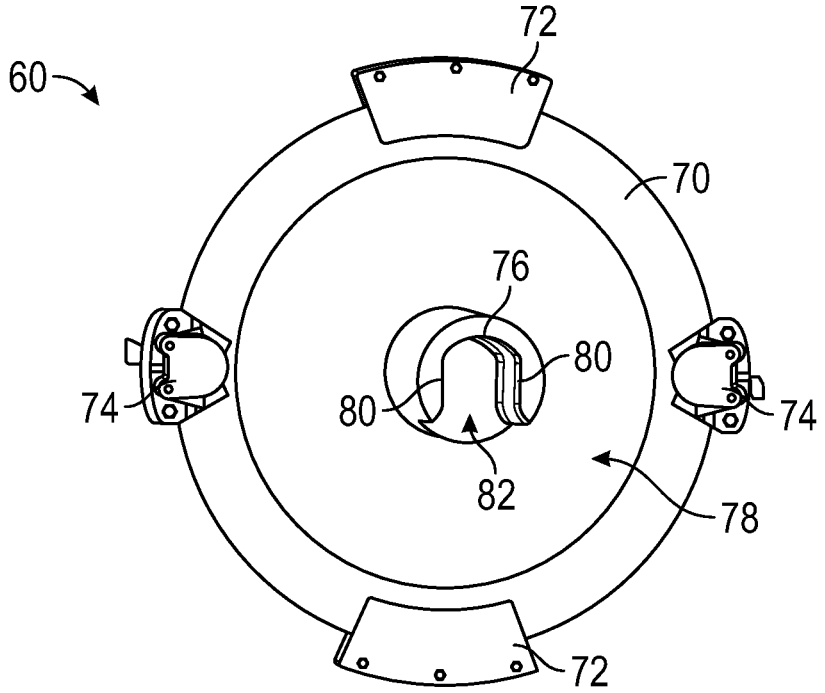
FIG. 7 is a side view of an example of the braking assembly of FIG. 6, in accordance with an embodiment of the present disclosure.

To help illustrate, a more detailed view of an example of a braking assembly 60, which may be included in pipe deployment equipment, is shown in FIG. 7. In addition to a brake disc 70, as in the depicted example, the braking assembly 60 may include one or more guide plates 72 and one or more brake pads 74, which are implemented proximate to the rim of the brake disc 70. In other words, at least in some embodiments, the one or more brake pads 74 may be implemented and/or operated to selectively engage the brake disc 70 and, thus, resist (e.g., slow) rotation of the brake disc 70.

Additionally, as depicted, the brake disc 70 includes a brake disc shaft socket 76 that is implemented on its inward-facing surface 78. In particular, as in the depicted example, the brake disc shaft socket 76 on the brake disc 70 may be keyed with one or more flat inner surfaces 80, for example, to facilitate matingly interlocking the brake disc shaft socket 76 with a drum shaft 54 of a pipe drum 52 and, thus, tying rotation of the pipe drum 52 with rotation of the brake disc 70. Furthermore, as in the depicted example, the brake disc shaft socket 76 may include a shaft insertion opening 82, which is implemented to enable a shaft, such as a drum shaft 54, to be inserted into the brake disc shaft socket 76.

However, it should be appreciated that the depicted example is merely intended to be illustrative and not limiting. In particular, in other embodiments, a braking assembly 60 of pipe deployment equipment may include less than two (e.g., one or even zero) brake pads 74 or more than two brake pads 74. Additionally or alternatively, in other embodiments, a braking assembly 60 of pipe deployment equipment may include less than two (e.g., zero or one) guide plates 72 or more than two guide plates 72. Furthermore, in other embodiments, a brake disc shaft socket 76 of a brake disc 70 in a braking assembly 60 may additionally or alternatively be keyed with a single flat inner surface 80 or more than two flat inner surfaces 80.

In any case, returning to FIG. 6, in some embodiments, the lifting assembly 68 of the pipe deployment trailer 42A may be operated to facilitate matingly interlocking a brake disc shaft socket 76 on the brake disc 70 with a drum shaft 54 of a pipe drum 52 that is to be loaded on the pipe deployment trailer 42. Although partially obfuscated from view by the braking assembly 60 and the equipment frame 66A, in the depicted example, the lifting assembly 68 may generally include one or more actuators (e.g., pullies) 84, which are implemented and/or operated to selectively raise (e.g., lift) lifting hooks and, thus, a shaft loaded on the lifting hook and/or to selectively lower (e.g., drop) the lifting hooks and, thus, the shaft loaded on the lifting hooks. In other words, in some such embodiments, the lifting assembly 68 may be operated to selectively raise the drum shaft 54 of the pipe drum 52 such that the drum shaft 54 is slid through a shaft insertion opening 82 into the brake disc shaft socket 76 on the brake disc 70, thereby tying rotation of the brake disc 70 to rotation of the pipe drum 52. In fact, to facilitate aligning the drum shaft 54 with the shaft insertion opening 82 of the brake disc shaft socket 76, in some embodiments, the pipe deployment trailer 42A may be implemented to enable the brake disc 70 to move slightly in a translational direction, for example, one inch, two inches, three inches, or more without moving the pipe deployment trailer 42A as a whole.

However, it should be appreciated that the depicted example is merely intended to be illustrative and not limiting. In particular, in other embodiments, a pipe deployment trailer 42 may not include a lifting assembly 68, for example, when the pipe deployment trailer 42 is implemented such that a pipe drum 52 is loaded thereon by contracting the pipe deployment trailer 42 around the pipe drum 52 and/or using separate equipment, such as an excavator or a crane. Additionally or alternatively, one or more trailer wheels 50 of a pipe deployment trailer 42 may instead be implemented as part of a trailer track assembly.

In any case, a pipe segment 20 may generally spooled (e.g., unspooled, unwound, and/or unwrapped) off of a pipe drum 52 at least in part by rotating the pipe drum 52 in a first direction. On the other hand, the pipe segment 20 may generally spooled (e.g., respooled, wound and/or wrapped) onto the pipe drum 52 at least in part by rotating the pipe drum 52 in a second direction opposite the first direction. In other words, to facilitate actively spooling (e.g., respooling and/or unspooling) using the pipe deployment trailer 42A, the spooling assembly 62A of the pipe deployment trailer 42A may be implemented and/or operated to enable controlling at least the rotational direction of a pipe drum 52, for example, in addition to rotational speed of the pipe drum 52.

To facilitate controlling rotational direction, as in the depicted example, in some embodiments, the spooling assembly 62 of pipe deployment equipment, such as a pipe deployment trailer 42, may include one or more motors 86. In particular, in some embodiments, a motor 86 in a spooling assembly 62 may be a fluid motor, such as hydraulic motor or a pneumatic motor. Additionally or alternatively, a motor 86 in the spooling assembly 62 may be an electric motor. However, as will be described in more detail below, in other embodiments, the spooling assembly 62 of pipe deployment equipment may not include a motor 86, for example, when the motor 86 is implemented external (e.g., separate) from the spooling assembly 62 and/or when operation of the spooling assembly 62 is driven by rotation of a trailer axle 69.

In any case, to facilitate controlling rotational speed, in the depicted example, the spooling assembly 62A additionally includes a gear box 88A with one or more intermediate gears, which are obfuscated from view by a housing 90 of the gear box 88A, that may be selectively connected between an input (e.g., drive) wheel (e.g., gear), which is obfuscated from view by the housing 90, and an output (e.g., driven) wheel (e.g., gear and/or sprocket) 92A of the gear box 88A. In particular, although obfuscated from view by the housing 90, the motor shaft of a motor 86 is connected to the input wheel of the gear box 88A, thereby tying rotation of the motor shaft to rotation of the input wheel and, thus, rotation the output wheel 92A of the gear box 88A. In fact, to facilitate adjusting rotational speed and/or torque resulting at the output wheel 92A, in some embodiments, different intermediate gears may be selectively connected between the input wheel and the output wheel 92A of the gear box 88A. For example, to facilitate increasing torque at the output wheel 92A, an intermediate gear with a larger diameter (e.g., lower gear) may be connected between the input wheel and the output wheel 92A of the gear box 88A. On the other hand, to facilitate increasing rotational speed at the output wheel 92A, an intermediate gear with a smaller diameter (e.g., higher gear) may be connected between the input wheel and the output wheel 92A of the gear box 88A.

Furthermore, to facilitate tying rotation of the output wheel 92A of the gear box 88A to rotation of the brake disc 70 in the braking assembly 60 while enabling translational movement of the brake disc 70, as in the depicted example, the spooling assembly 62A may additionally include a looped member 94—namely an output looped member 94A, such as a chain or a belt, that is connected to (e.g., around) the output wheel 92A and the brake disc 70. To facilitate connecting the looped member 94 to the brake disc 70, as depicted, a brake disc wheel (e.g., gear and/or sprocket) 96 is secured to an outward-facing surface 98 of the brake disc 70. In this manner, rotational speed and rotational direction of a motor shaft that results from operation of a corresponding motor 86 in the spooling assembly 62A may be tied to rotational speed and rotational direction of the brake disc 70 in the braking assembly 60 and, thus, used to control spooling of a pipe segment 20 onto and/or off of a pipe drum 52 that is secured to the brake disc 70.

However, it should again be appreciated that the depicted example is merely intended to be illustrative and not limiting. In particular, in other embodiments, a spooling assembly 62 on pipe deployment equipment may not include a gear box 88 or a looped member 94, for example, when a motor shaft of a motor 86 in the spooling assembly 62 is secured (e.g., welded and/or bolted) directly to the outward-facing surface 98 of a corresponding brake disc 70. Additionally, as will be described in more detail below, in other embodiments, a spooling assembly 62 on pipe deployment equipment may not include an output looped member 94A, for example, when an output wheel 92 of a gear box 88 in the spooling assembly 62 is secured directly to the outward-facing surface 98 of a corresponding brake disc 70. Furthermore, in other embodiments, a spooling assembly 62 on pipe deployment equipment may include a separate disc that is implemented to have its rotation tied to a pipe drum 52, for example, instead of using a brake disc 70 in a braking assembly 60 of the pipe deployment equipment.

In any case, to facilitate powering operation of a motor 86 in the spooling assembly 62A, as depicted, the portion 64A of the pipe deployment system 38 includes a power sub-system 100, for example, which is implemented (e.g., secured and/or disposed) on the equipment frame 66A of the pipe deployment trailer 42A. As described above, in some embodiments, a motor 86 in a spooling assembly 62 may be a fluid motor, such as a hydraulic motor or a pneumatic motor. Thus, in such embodiments, the power sub-system 100 may include a fluid source that is implemented and/or operated to selectively power the motor 86 at least in part by selectively supplying (e.g., flowing) fluid (e.g., liquid and/or gas) to the motor 86 and/or selectively extracting (e.g., flowing) from the motor 86. Additionally or alternatively, as described above, in some embodiments, a motor 86 in a spooling assembly 62 may be an electric motor. Thus, in such embodiments, the power sub-system 100 may include an electrical power source that is implemented and/or operated to selectively supply electrical power (e.g., electrical current) to the motor 86 in the spooling assembly 62.

To facilitate supplying power (e.g., electrical power and/or pressurized fluid) to the spooling assembly 62, as depicted, one or more power conduits 102 are connected between the power sub-system 100 and a motor 86 in the spooling assembly 62A. For example, when a motor 86 in the spooling assembly 62A is a fluid motor, a power conduit 102 connected between the power sub-system 100 and the motor 86 may be a fluid (e.g., liquid and/or gas) conduit. Additionally or alternatively, when a motor 86 in the spooling assembly 62A is an electric motor, a power conduit 102 connected between the power sub-system 100 and the motor 86 may be an electrical conduit, such as a wire or a cable.

Furthermore, to facilitate controlling operation of the pipe deployment system 38, as depicted, the portion 64A of the pipe deployment system 38 additionally includes a control sub-system 104. In fact, in some embodiments, the control sub-system 104 may be implemented and/or operated to autonomously control operation of the pipe deployment system 38, for example, with little or no user intervention. In any case, to facilitate controlling operation, as in the depicted example, in some embodiments, the control sub-system 104 may be communicatively coupled to one or more sensors 106.

Generally, a sensor 106 in a pipe deployment system 38 may be implemented and/or operated to determine sensor data indicative of one or more operational parameters of the pipe deployment system 38, which may be communicated to a control sub-system 104 in the pipe deployment system 38 via one or more sensor signals 107. For example, a tension sensor 106 may determine sensor data indicative of tension being exerted on a pipe segment 20 that is being spooled onto and/or off from a pipe drum 52 by the pipe deployment trailer 42A. Additionally or alternatively, a torque sensor 106 may determine sensor data indicative of torque that is exerted on a pipe drum 52 onto and/or off of which a pipe segment 20 is being spooled, which may then be processed (e.g., by a control sub-system 104) based at least in part on the diameter of a pipe coil that is formed by the portion of the pipe segment 20 disposed around the drum body 55 of the pipe drum 52 to determine the tension exerted on the pipe segment 20. Furthermore, a pressure sensor 106 may determine sensor data indicative of fluid pressure flowing between the power sub-system 100 and a motor 86 in the pipe deployment system 38. In fact, in some embodiments, the fluid pressure flowing between the power sub-system 100 and the motor 86 may be indicative of the tension produced on a pipe segment 20 that is being spooled (e.g., unspooled and/or respooled) by the pipe deployment system 38. In other words, at least in some such embodiments, a separate tension sensor 106 and/or a separate torque sensor 106 may be obviated by the pressure sensor 106 and, thus, not included in the pipe deployment system 38.

In any case, to facilitate controlling operation of the pipe deployment system 38, as depicted, the control sub-system 104 includes one or more processors 108, memory 110, and one or more input/output (I/O) devices 112. In some embodiments, the memory 110 in the control sub-system 104 may include one or more tangible, non-transitory, computer-readable media that are implemented and/or operated to store data and/or executable instructions. For example, the memory 110 may store sensor data based at least in part on one or more sensor signals 107 received from a sensor 106. As such, in some embodiments, the memory 110 may include volatile memory, such as random-access memory (RAM), and/or non-volatile memory, such as read-only memory (ROM), flash memory, a solid-state drive (SSD), a hard disc drive (HDD), or any combination thereof.

Additionally, in some embodiments, a processor 108 in the control sub-system 104 may include processing circuitry that is implemented and/or operated to process data and/or to execute instructions stored in memory 110. In other words, in some such embodiments, a processor 108 in the control sub-system 104 may include one or more general purpose microprocessors, one or more application specific integrated circuits (ASICs), one or more field programmable gate arrays (FPGAs), or any combination thereof. For example, a processor 108 in the control sub-system 104 may process sensor data that is determined by a pressure sensor 106 to determine tension that is exerted on a pipe segment 20 being spooled (e.g., unspooled and/or respooled) by a spooling assembly 62 on pipe deployment equipment.

Additionally or alternatively, a processor 108 in the control sub-system 104 may execute instructions stored in memory 110 to determine one or more control (e.g., command) signals 114 that instruct the pipe deployment system 38 to perform corresponding control actions. For example, the control sub-system 104 may determine a control signal 114 that instructs the power sub-system 100 to supply power (e.g., electrical power and/or pressured fluid) to a motor 86 in the pipe deployment system 38. As another example, the control sub-system 104 may determine a control signal 114 that instructs a brake pad actuator in a braking assembly 60 on pipe deployment equipment to engage a corresponding brake pad 74 with the brake disc 70 in the braking assembly 60. As a further example, the control sub-system 104 may determine a control signal 114 that instructs a gear box 88 in a spooling assembly 62 of pipe deployment equipment to change an intermediate gear that is connected between its input (e.g., drive) wheel (e.g., gear) and its output (e.g., driven) wheel (e.g., gear and/or sprocket) 92 or to disconnect the input wheel and the output wheel from one another.

In any case, to enable communication outside of the control sub-system 104, in some embodiments, the I/O devices 112 of the control sub-system 104 may include one or more input/output (I/O) ports (e.g., terminals). Additionally, to facilitate communicating operational status of a pipe deployment system 38 to a user (e.g., operator or service technician), in some embodiments, the I/O devices 112 of the control sub-system 104 may include one or more user output devices, such as an electronic display, which is implemented and/or operated to display a graphical user interface (GUI) that provides a visual representation of one or more operational parameters of the pipe deployment system 38. Furthermore, to enable user interaction with a pipe deployment system 38, in some embodiments, the I/O devices 112 of the control sub-system 104 may include one or more user input devices, such as a hard button, a soft button, a keyboard, a mouse, and/or the like. In any case, in this manner, pipe deployment equipment, such as a pipe deployment trailer 42, may be implemented to enable the pipe deployment equipment to operate to deploy a pipe segment 20 into a pipeline system 10 as well as to actively spool (e.g., unspool and/or respool) the pipe segment 20 onto and/or off of a pipe drum 52, which, at least in some instances, may facilitate improving deployment efficiency of the pipeline system 10, for example, at least in part by obviating separate spooling equipment and, thus, transfer of the pipe drum 52 between the deployment equipment and the separate spooling equipment.

However, it should again be appreciated that the depicted example is merely intended to be illustrative and not limiting. In particular, in other embodiments, a control sub-system 104 of a pipe deployment system 38 may be implemented on an equipment frame 66 of pipe deployment equipment in the pipe deployment system 38, for example, instead of being implemented remote relative to the pipe deployment equipment. Additionally or alternatively, in other embodiments, a power sub-system 100 of a pipe deployment system 38 may be implemented proximate to pipe deployment equipment in the pipe deployment system 38, for example, instead of being implemented directly on an equipment frame 66 of the pipe deployment equipment. Furthermore, in other embodiments, a pipe deployment system 38 may additionally or alternatively not include sensors 106, for example, when operation of the pipe deployment system 38 is to be controlled manually. Moreover, in other embodiments, the techniques described in the present disclosure may be applied to other types of pipe deployment equipment included in a pipe deployment system 38.

Figure 8:
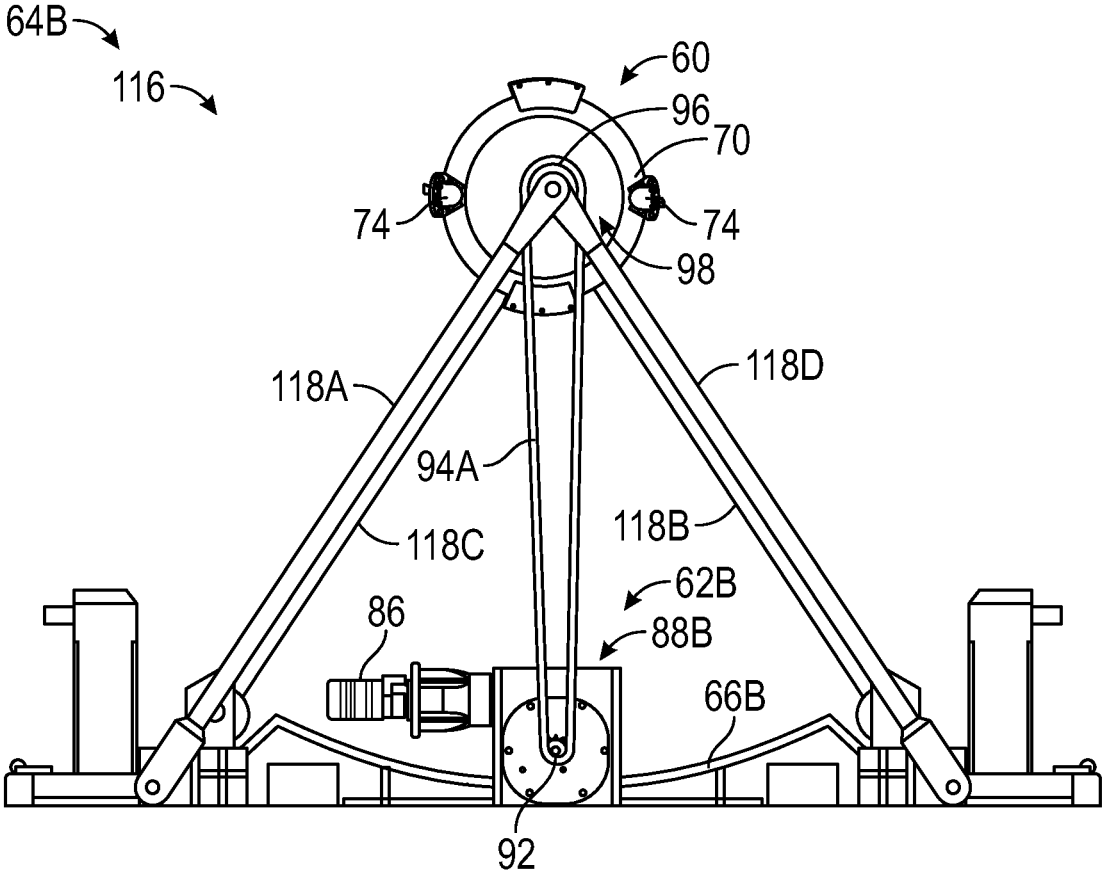
FIG. 8 is another example of pipe deployment equipment—namely a pipe deployment frame—with a braking assembly and a spooling assembly, in accordance with an embodiment of the present disclosure.

To help illustrate, another example of a portion 64B of a pipe deployment system 38 that includes pipe deployment equipment—namely a pipe deployment frame 116—is shown in FIG. 8. However, it should be appreciated that the depicted example is merely intended to be illustrative and not limiting. In particular, as described above, a pipe deployment system 38 may additionally include a control sub-system 104, one or more sensors 106 communicatively coupled to the control sub-system 104, a power sub-system 100, one or more power conduits 102 connected to the power sub-system 100, or any combination thereof. In any case, similar to FIG. 6, as depicted in FIG. 8, the pipe deployment frame 116 includes an equipment frame 66B, a braking assembly 60, and a spooling assembly 62B.

However, as depicted in FIG. 8, the pipe deployment frame 116 additionally includes support arms 118—namely a first support arm 118A, a second support arm 118B, a third support arm 118C, and a fourth support arm 118D—that are secured to the equipment frame 66B. In particular, in the depicted example, the first support arm 118A and the second support arm 118B are closer to the viewer whereas the third support arm 118C and the fourth support arm 118D are farther from the viewer. Additionally, as in the depicted example, the braking assembly 60 may be secured to the first support arm 118A and the second support arm 118B, for example, instead of being secured directly to the equipment frame 66B.

Nevertheless, similar to FIG. 6, the braking assembly 60 of FIG. 8 includes a brake disc 70, one or more brake pads 74 implemented proximate to the rim of the brake disc 70, and a disc wheel (e.g., gear and/or sprocket) 96 secured to the outward-facing surface 98 of the brake disc 70. In fact in some embodiments, the braking assembly 60 of FIG. 8 may generally match the braking assembly 60 of FIG. 6. In other words, in such embodiments, the braking assembly 60 of FIG. 8 may generally be implemented and/or operated in the same manner as the braking assembly 60 of FIG. 6.

Additionally, similar to FIG. 6, the spooling assembly 62B of FIG. 8 includes a gear box 88B, a motor 86 that has its motor shaft connected to an input (e.g., drive) wheel (e.g., gear) of the gear box 88B, a brake disc wheel 96 secured to the brake disc 70, and an output looped member 94A, such as a chain and/or a belt, that is secured around an output (e.g., driven) wheel (e.g., gear and/or sprocket) 92B of the gear box 88B and the brake disc wheel 96. In fact, in some embodiments, the spooling assembly 62B of FIG. 8 may generally match the spooling assembly 62A of FIG. 6 and, thus, may generally be implemented and/or operated in the same manner as the spooling assembly 62A of FIG. 6. In other words, in such embodiments, pipe deployment equipment, such as a pipe deployment frame 116, may be implemented to enable the pipe deployment equipment to operate to deploy a pipe segment 20 into a pipeline system 10 as well as to actively spool (e.g., unspool and/or respool) the pipe segment 20 onto and/or off of a pipe drum 52, which, at least in some instances, may facilitate improving deployment efficiency of the pipeline system 10, for example, by obviating separate spooling equipment and, thus, transfer of the pipe drum 52 between the deployment equipment and the separate spooling equipment.

However, it should again be appreciated that the depicted example is merely intended to be illustrative and not limiting. In particular, as will be described in more detail below, in other embodiments, a spooling assembly 62 on pipe deployment equipment may include multiple looped members 94. Additionally, as mentioned above, in other embodiments, the output wheel 92 of a gear box 88 in a spooling assembly 62 may be secured directly to a brake disc 70 in a corresponding braking assembly 60.

Figure 9:
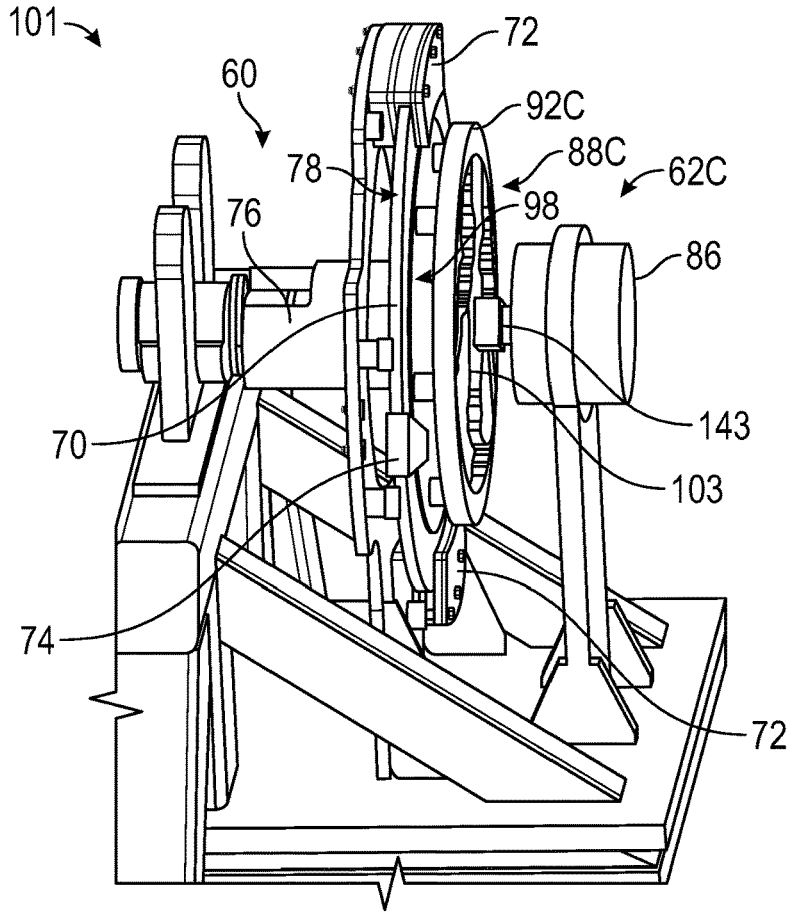
FIG. 9 in an example of a portion of pipe deployment equipment that includes braking assembly and a spooling assembly, which has a gear box secured directly to a brake disc of the braking assembly, in accordance with an embodiment of the present disclosure.

To help illustrate, an example of a portion 101 of pipe deployment equipment, such as a pipe deployment trailer 42 or a pipe deployment frame 116, that includes a braking assembly 60 and a spooling assembly 62C is shown in FIG. 9. Similar to FIG. 6, as depicted in FIG. 9, the braking assembly 60 includes a brake disc 70, which has a brake disc shaft socket 76 on its inward-facing surface 78, as well as guide plates 72 and brake pads 74, which are implemented along the rim of the brake disc 70. Additionally, similar to FIG. 6, as depicted in FIG. 9, the spooling assembly 62C includes a motor 86 and a gear box 88C.

However, as depicted in FIG. 9, the output (e.g., driven) wheel (e.g., gear) 92C of the gear box 88C is secured directly to the outward-facing surface 98 of the brake disc 70, for example, instead of via a looped member 94 and a brake disc wheel 96. Additionally, as depicted, a motor shaft 143 of the motor 86 is secured to the input (e.g., drive) wheel (e.g., gear) 105 of the gear box 88C. Furthermore, as in the depicted example, in some embodiments, the gear box 88 in a spooling assembly 62 may be a planetary gear box 88.

Figure 10:
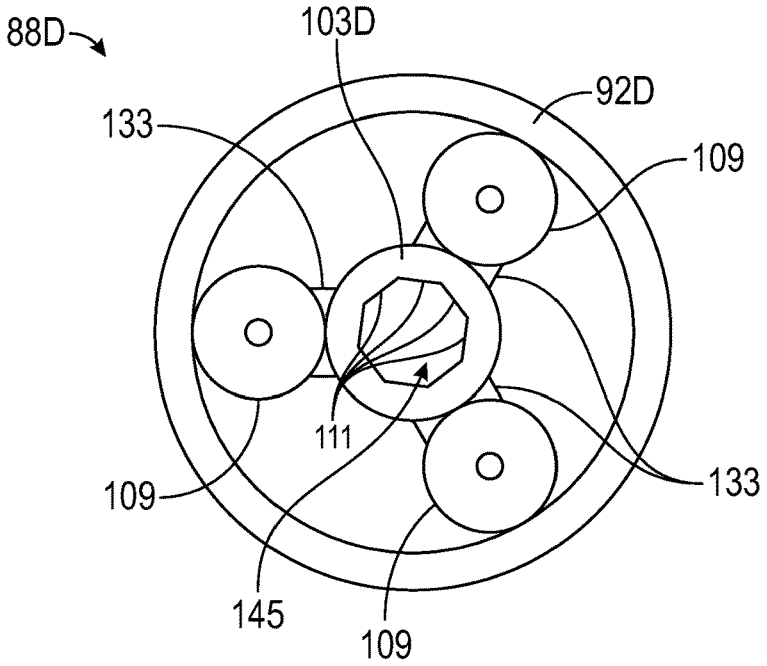
FIG. 10 is a frontal view of an example of the gear box of FIG. 9, in accordance with an embodiment of the present disclosure.

To help illustrate, an example of a planetary gear box 88D, which may be included in a spooling assembly 62, is shown in FIG. 10. As depicted, the planetary gear box 88D includes an output wheel 92—namely a ring gear 92D—and a carrier 133 that is rotatably disposed within the ring gear 92D. Additionally, as depicted, the planetary gear box 88D includes intermediate (e.g., planet) gears 109, which are each rotatably secured to the carrier 133, as well as an input wheel 103—namely a sun gear 103D, which is disposed between the intermediate gears 109.

In particular, the sun gear 103D is implemented with teeth that mesh the teeth on the intermediate gears 109. Additionally, the teeth of each intermediate gear 109 is implemented to mesh with the teeth on the ring gear 92D. Accordingly, rotation of the sun gear 103D may cause the intermediate gears 109 to rotate (e.g., revolve) around the sun gear 103D, which then cause the ring gear 92D to rotate about the sun gear 103D.

As described above, in some embodiments, the input wheel (e.g., sun gear) 103 of a gear box 88 in a spooling assembly 62 may be driven by a motor 86 in the spooling assembly 62. To enable a motor shaft 143 to drive its operation, as in the depicted example, in some embodiments, the input wheel 103 of a gear box 88 may include an input wheel shaft socket 145 that is keyed with one or more flat inner surfaces 111. In particular, in the depicted example, the input wheel shaft socket 145 is keyed with eight flat inner surfaces 111 and, thus, an orthogonal inner surface. As such, to facilitate matingly interlocking a motor shaft 143 with the input wheel 92 of a gear box 88 and, thus, driving operation of the gear box 88 using the motor shaft 143, the motor shaft 143 may be keyed with one or more corresponding flat outer surfaces. For example, when the input wheel shaft socket 145 is keyed with eight flat inner surfaces 111, the motor shaft 143 may be keyed with eight flat outer surfaces and, thus, an orthogonal outer surface.

However, it should be appreciated that the depicted example is merely intended to be illustrative and not limiting. In particular, in other embodiments, an input wheel shaft socket 145 of a gear box 88 in a spooling assembly 62 may be keyed with a different shape, for example, which includes more than eight (e.g., nine, ten, or more) flat inner surfaces 111 or fewer than eight (e.g., seven, six, or fewer) flat inner surfaces 111. Additionally or alternatively, in other embodiments, a gear box 88 in a spooling assembly 62 may include fewer than three (e.g., one or two) intermediate gears 109 or more than three (e.g., four, five, or more) intermediate gears 109. Moreover, as mentioned above, in some embodiments, a motor 86 in a pipe deployment system 38 that is used to drive operation of a spooling assembly 62 on pipe deployment equipment in the pipe deployment system 38 may be separate from the pipe deployment equipment and, thus, external from the spooling assembly 62.

Figure 11:
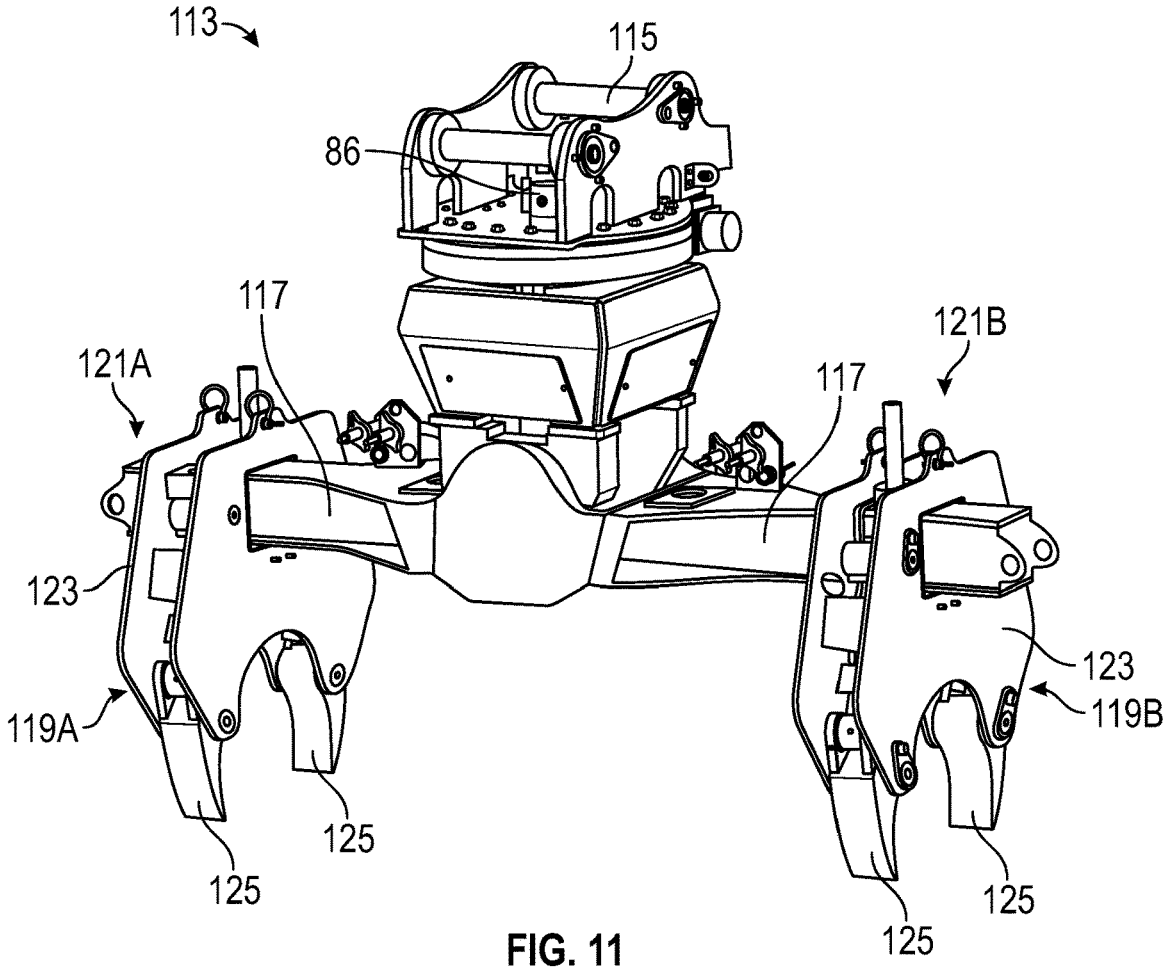
FIG. 11 is a perspective view of an example of a pipe handler that can be used to drive operation of a spooling assembly, in accordance with an embodiment of the present disclosure.

To help illustrate, an example of a pipe handler 113, which may be included in a pipe deployment system 38, is shown in FIG. 11. As depicted, the pipe handler 113 includes an attachment 115, which may be used to attach the pipe handler 113 to other equipment, such as an excavator, a crane, or the like. Thus, in some embodiments, the other equipment may operate to move the pipe handler 113, for example, via one or more motors 86 in the other equipment.

However, in the depicted example, the pipe handler 113 additionally includes its own motor 86, which is secured between the attachment 115 and a central beam 117. In some embodiments, the motor 86 in the pipe handler 113 may be a fluid motor, such as hydraulic motor or a pneumatic motor. In other embodiments, the motor 86 in the pipe handler 113 may be an electric motor. Thus, to power its operation, in some embodiments, pipe handler 113 may be connected to a power sub-system 100, for example, via one or more power conduits 102. In any case, in this manner, the pipe handler 113 may operate to rotate the central beam 117 relative to the attachment 115.

Additionally, as in the depicted example, a pipe handler 113 in a pipe deployment system 38 may include one or more arm assemblies 119. In particular, in the depicted example, the pipe handler 113 includes a first arm assembly 119A secured on a first side 121A of the central beam 117 and a second arm assembly 119B secured on a second side 121B of the central beam 117. Nevertheless, in some embodiments, arm assemblies 119 may be selectively secured to the central beam 117 of a pipe handler 113 and, thus, the pipe handler 113 may include a single arm assembly 119.

In any case, as in the depicted example, an arm assembly 119 of a pipe handler 113 generally includes an arm body 123. In particular, in some embodiments, the arm body 123 in an arm assembly 119 of a pipe handler 113 may be slidably secured to the central beam 117 of the pipe handler 113. The arm assembly 119 may also include a pair of arm clamps 125, which are pivotably connected to the arm body 123 such that they open towards one another. Although obfuscated from view by its arm body 123, the arm assembly 119 additionally includes actuators, which are each secured to the arm body 123 and a corresponding arm clamp 125.

As such, an arm assembly 119 of a pipe handler 113 may generally be implemented and/or operated to enable the pipe handler 113 to selective grab onto an object. In particular, the pipe handler 113 may grab onto an object disposed between the arm clamps 125 of the arm assembly 119 at least in part by operating the arm assembly 119 to move the arm clamps 125 toward one another. On the other hand, the pipe handler 113 may release the object at least in part by operating the arm assembly 119 to move the arm clamps 125 away from one another.

In fact, in some embodiments, the ability of an arm assembly 119 of a pipe handler 113 to selectively grab onto an object may enable a motor 86 in the pipe handler 113 to be used to drive operation of a spooling assembly 62 on pipe deployment equipment. In other words, in such embodiments, operation of the spooling assembly 62 may be driven by a motor 86 that is separate from the pipe deployment equipment and, thus, external from the spooling assembly 62. Accordingly, at least in some such embodiments, a pipe handler 113 may obviate a motor 86 in a spooling assembly 62 on pipe deployment equipment and, thus, the spooling assembly 62 may not include a motor 86.

Figure 12:
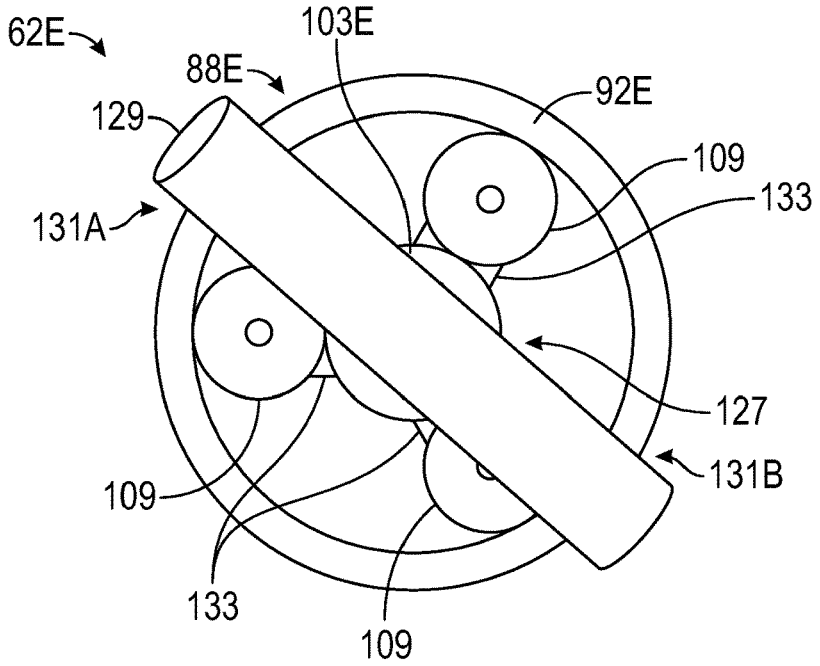
FIG. 12 is a frontal view of an example of a spooling assembly that can be driven by the pipe handler of FIG. 11, in accordance with an embodiment of the present disclosure.

To help illustrate, an example of a spooling assembly 62E, which does not include a motor 86, is shown in FIG. 12. As depicted, the spooling assembly 62E includes a gear box 88—namely a planetary gear box 88E. Similar to FIG. 10, as depicted in FIG. 12, the planetary gear box 88E includes an output wheel 92—namely a ring gear 92E, a carrier 133, which is rotatably disposed within the ring gear 92E, intermediate (e.g., planet) gears 109, which are each rotatably secured to the carrier 133, and an input wheel 103—namely a sun gear 103E, which is disposed between the intermediate gears 109. In fact, in some embodiments, the planetary gear box 88E of FIG. 12 may generally match the planetary gear box 88D of FIG. 10.

However, as depicted in FIG. 12, a handle 127 is secured to the sun gear 103E of the planetary gear box 88E. As depicted, the handle 127 includes a handle bar 129. Although obfuscated from view by the handle bar 129, the handle 127 additionally includes a handle shaft that extends out from the handle bar 129 and that matingly interlocks with the sun gear 103E to tie rotation of the sun gear 103E and, thus, operation of the planetary gear box 88E to rotation of the handle bar 129.

As described above, in some embodiments, the input wheel (e.g., sun gear) 103 of a gear box 88 in a spooling assembly 62 may include an input wheel shaft socket 145 that is keyed with one or more flat inner surfaces 111. Thus, to facilitate matingly interlocking with the input wheel 103, in such embodiments, the handle shaft of a handle 127 may be keyed with one or more corresponding flat outer surfaces. For example, when the input wheel shaft socket 145 is keyed with eight flat inner surfaces 111, the handle shaft of the handle 127 may be keyed with eight flat outer surfaces and, thus, an orthogonal outer surface.

In any case, in some instances, a handle 127 secured to a gear box 88 in a spooling assembly 62 may be manually rotated, for example, by an operator, such as a service technician. In other instances, a handle 127 secured to a gear box 88 in a spooling assembly 62 may be rotated via a pipe handler 113. For example, in such instances, a first arm assembly 119A of the pipe handler 113 may grab onto a first side 131A of the handle bar 129 while a second arm assembly 119B of the pipe handler 113 grabs onto a second (e.g., opposite) side 131B of the handle bar 129. The motor 86 of the pipe handler 113 may then be operated to rotate the arm assemblies 119, which rotates the handle 127 and, thus, the sun gear 103E of the planetary gear box 88E. In this manner, a spooling assembly 62 on pipe deployment equipment may be implemented and/or operated to facilitate actively spooling a pipe segment 20 onto and/or off of a pipe drum 52 using a motor 86 that is separate (e.g., external) from the spooling assembly 62.

However, it should be appreciated that the depicted example is merely intended to be illustrative and not limiting. In particular, in other embodiments, a handle 127 in a spooling assembly 62 may be implemented to matingly interlock with a different type of gear box 88, for example, which is not a planetary gear box. Additionally or alternatively, in other embodiments, a handle 127 in a spooling assembly 62 may be implemented with a different shape, for example, an L-shape instead of a T-shape. Moreover, as mentioned above, in other embodiments, a spooling assembly 62 on pipe deployment equipment, such as a pipe deployment trailer 42, that does not include a motor 86 may instead use rotation of one or more trailer axles 69 of the pipe deployment equipment to drive its operation.

Figure 13:
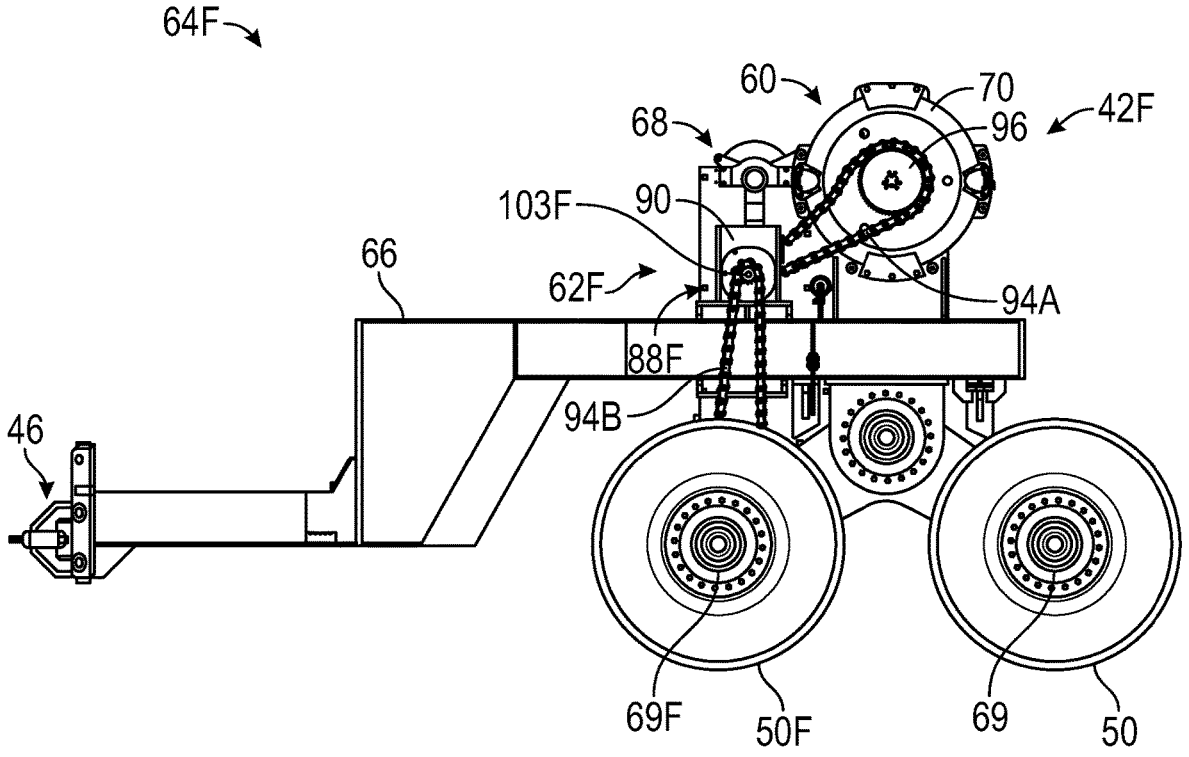
FIG. 13 is a side view of another example of the pipe deployment trailer of FIG. 4 with a spooling assembly that is driven by a trailer axle, in accordance with an embodiment of the present disclosure.

To help illustrate, another example of a portion 64F of a pipe deployment system 38 that includes a pipe deployment trailer 42F is shown in FIG. 13. However, it should be appreciated that the depicted example is merely intended to be illustrative and not limiting. In particular, as described above, a pipe deployment system 38 may additionally include a control sub-system 104, one or more sensors 106 communicatively coupled to the control sub-system 104, a tow vehicle 40 secured to the pipe deployment trailer 42F, or any combination thereof.

In any case, similar to FIG. 6, as depicted in FIG. 13, the pipe deployment trailer 42F includes a tongue assembly 46, trailer wheels 50, a braking assembly 60, a spooling assembly 62F, and a lifting assembly 68, which are each secured to its equipment frame 66. In fact, in some embodiments, the tongue assembly 46 of FIG. 13 may generally match the tongue assembly 46 of FIG. 6, the braking assembly 60 of FIG. 13 may generally match the braking assembly 60 of FIG. 6, the lifting assembly 68 of FIG. 13 may generally match the lifting assembly 68 of FIG. 6, or any combination thereof. Additionally, similar to FIG. 6, as depicted in FIG. 13, the trailer wheels 50 are each rotatably secured to the equipment frame 66 of the pipe deployment trailer 42F via corresponding trailer axles 69.

However, as depicted in FIG. 13, the spooling assembly 62F of the pipe deployment trailer 42F additionally includes an input (e.g., trailer axle) looped member 94B, such as a chain and/or a belt, that is secured around an input (e.g., drive) wheel (e.g., gear and/or sprocket) 103F of the gear box 88F in the spooling assembly 62F. Although obfuscated from view by a trailer wheel 50F, the input looped member 94B is also secured around a corresponding trailer axle 69F. Nevertheless, similar to FIG. 6, as depicted in FIG. 13, the spooling assembly 62F includes an output looped member 94A that is secured around the output (e.g., driven) wheel (e.g., gear and/or sprocket) 92 of the gear box 88F, which is obfuscated from view by the housing 90 of the gear box 88F, and the brake disc wheel 96, which is secured to the brake disc 70 in the braking assembly 60.

As such, when the input wheel 103F and the output wheel 92 of the gear box 88F are connected, rotation of the trailer axle 69F may cause the brake disc wheel 96 and, thus, the brake disc 70 to rotate. In other words, in some embodiments, the spooling assembly 62F may enable the pipe deployment trailer 42F to actively spool a pipe segment 20 while it is being moved (e.g., towed), for example, by a tow vehicle 40. Thus, when active rotation of the brake disc 70 is not targeted (e.g., desired) for performance, in such embodiments, the input wheel 103F and the output wheel 92 of the gear box 88F may be disconnected from one another.

However, it should again be appreciated that the depicted example is merely intended to be illustrative and not limiting. In particular, in other embodiments, an input wheel 103 of a gear box 88 in a spooling assembly 62 may not be connected to a corresponding trailer axle 69 via an input looped member 94B, for example, instead being connected directly to the trailer axle 69. Additionally, as mentioned above, in other embodiments, a spooling assembly 62 of pipe deployment equipment may not include a gear box 88.

Figure 14:
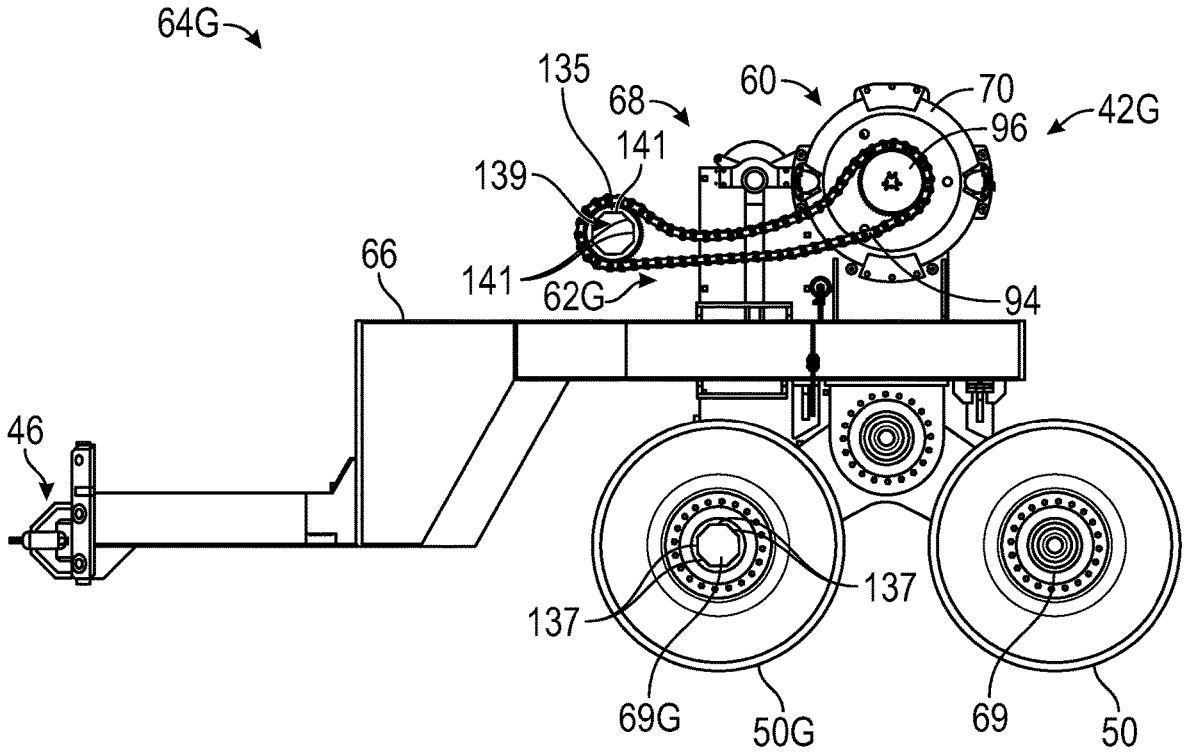
FIG. 14 is a side view of an of the pipe deployment trailer of FIG. 4 with a spooling assembly that includes a trailer axle wheel, in accordance with an embodiment of the present disclosure.

To help illustrate, another example of a portion 64G of a pipe deployment system 38 that includes a pipe deployment trailer 42G is shown in FIG. 14. However, it should be appreciated that the depicted example is merely intended to be illustrative and not limiting. In particular, as described above, a pipe deployment system 38 may additionally include a control sub-system 104, one or more sensors 106 communicatively coupled to the control sub-system 104, a tow vehicle 40 secured to the pipe deployment trailer 42G, or any combination thereof.

In any case, similar to FIG. 6, as depicted in FIG. 14, the pipe deployment trailer 42G includes a tongue assembly 46, trailer wheels 50, a braking assembly 60, a spooling assembly 62G, and a lifting assembly 68, which are each secured to its equipment frame 66. In fact, in some embodiments, the tongue assembly 46 of FIG. 14 may generally match the tongue assembly 46 of FIG. 6, the braking assembly 60 of FIG. 14 may generally match the braking assembly 60 of FIG. 6, the lifting assembly 68 of FIG. 14 may generally match the lifting assembly 68 of FIG. 6, or any combination thereof. Additionally, similar to FIG. 6, as depicted in FIG. 14, the trailer wheels 50 are each rotatably secured to the equipment frame 66 of the pipe deployment trailer 42G via corresponding trailer axles 69.

However, as depicted in FIG. 14, the spooling assembly 62G of the pipe deployment trailer 42G additionally includes a trailer axle wheel (e.g., gear and/or sprocket) 135 and a looped member 94 that is secured around the trailer axle wheel 135 and the brake disc wheel 96, which is secured to the brake disc 70 in the braking assembly 60. In particular, the trailer axle wheel 135 is implemented to matingly interlock with a trailer axle 69G via which a trailer wheel 50G rotates. To facilitate matingly interlocking a trailer axle wheel 135 and a trailer axle 69, as in the depicted example, an outer end of the trailer axle 69 may be keyed with one or more flat outer surfaces 137 while the trailer axle wheel 135 includes an axle socket 139 that is keyed with one or more flat inner surfaces 141. For example, in the depicted example, the trailer axle 69G is keyed with eight flat outer surfaces 137 and, thus, an orthogonal outer surface while the axle socket 139 is eyed with eight flat inner surfaces 141 and, thus, an orthogonal inner surface.

As such, when the trailer axle wheel 135 is matingly interlocked with the trailer axle 69G, rotation of the trailer axle 69G may cause the brake disc wheel 96 and, thus, the brake disc 70 to rotate. In other words, in some embodiments, the spooling assembly 62G may enable the pipe deployment trailer 42G to actively spool a pipe segment 20 while it is being moved (e.g., towed), for example, by a tow vehicle 40. Thus, when active rotation of the brake disc 70 is not targeted (e.g., desired) for performance, in such embodiments, the trailer axle wheel 135 may be disconnected from the trailer axle 69G.

However, it should again be appreciated that the depicted example is merely intended to be illustrative and not limiting. In particular, in other embodiments, the outer end of a trailer axle 69 may be keyed with a different shape, for example, which includes more than eight (e.g., nine, ten, or more) flat outer surfaces 137 or fewer than eight (e.g., seven, six, or fewer) flat outer surfaces 137. Additionally, in other embodiments, the trailer axle wheel 135 in a spooling assembly 62 may include an axle socket 139 that is keyed with a different shape, for example, which includes more than eight (e.g., nine, ten, or more) flat inner surfaces 141 or fewer than eight (e.g., seven, six, or fewer) flat inner surfaces 141. Furthermore, in other embodiments, the trailer axle wheel 135 in a spooling assembly 62 may include a plug that is keyed with one or more flat outer surfaces while the outer end of a corresponding trailer axle 69 includes a plug socket that is keyed with one or more flat inner surfaces. In any case, in this manner pipe deployment equipment, such as a pipe deployment trailer 42 or a pipe deployment frame 116, may be implemented to enable the pipe deployment equipment to operate to facilitate deploying a pipe segment 20 into a pipeline system 10 as well as actively spooling (e.g., unspooling and/or respooling) the pipe segment 20 onto and/or off of a pipe drum 52, which, at least in some instances, may facilitate improving deployment efficiency of the pipeline system 10, for example, by obviating separate spooling equipment and, thus, transfer of the pipe drum 52 between the deployment equipment and the separate spooling equipment.

Figure 15:
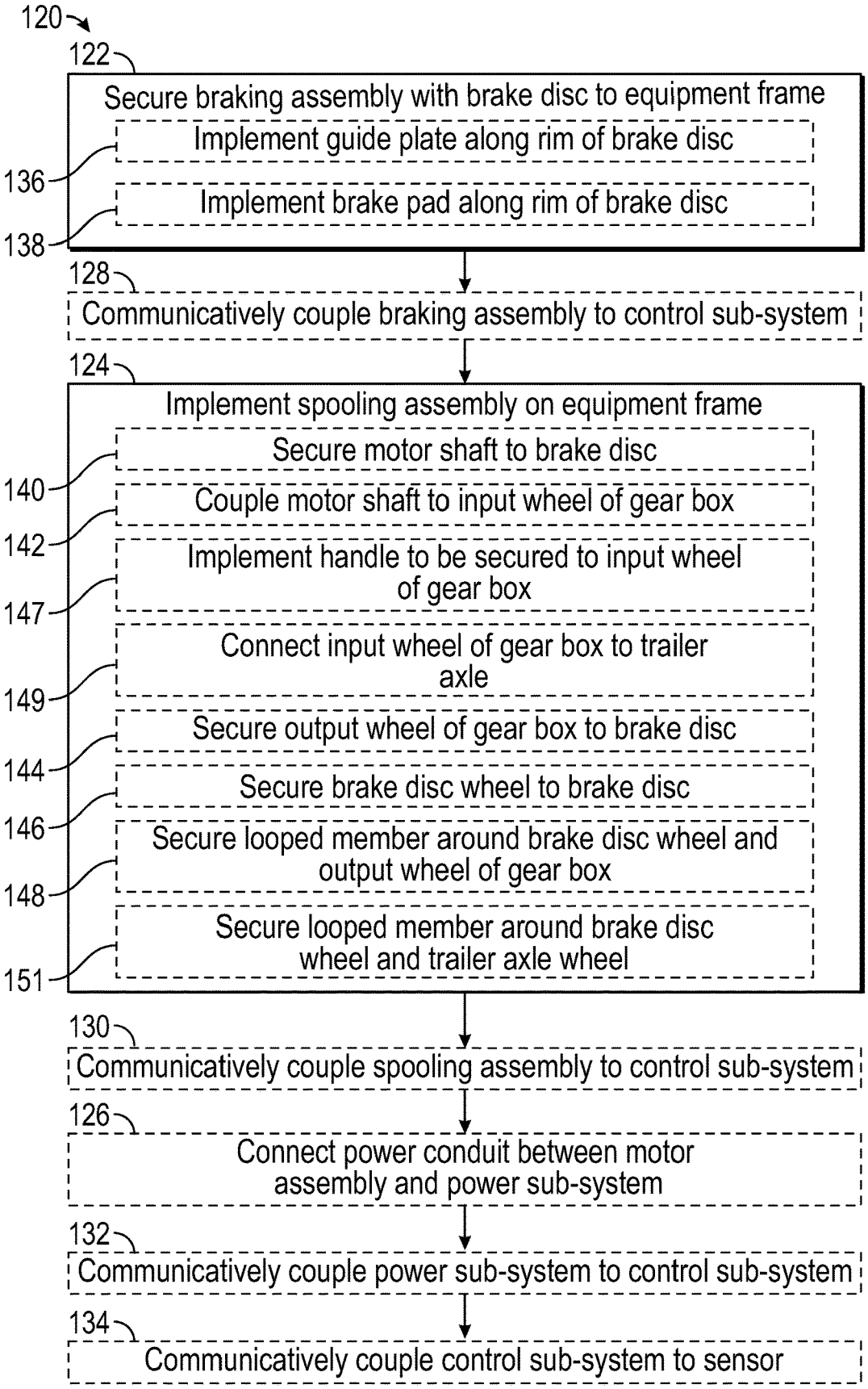
FIG. 15 is flow diagram of an example of a process for implementing a pipe deployment system that includes pipe deployment equipment, in accordance with an embodiment of the present disclosure.

To help further illustrate, an example of a process 120 for implementing a pipe deployment system 38 that includes pipe deployment equipment, such as a pipe deployment trailer 42 or a pipe deployment frame 116, is described in FIG. 15. Generally, the process 120 includes securing a braking assembly with a brake disc to an equipment frame (process block 122). Additionally, the process 120 generally includes implementing a spooling assembly on the equipment frame (process block 124).

Although described in a specific order, which corresponds with an embodiment of the present disclosure, it should be appreciated that the example process 120 is merely intended to be illustrative and not limiting. In particular, in other embodiments, a process 120 for implementing a pipe deployment system 38 may include one or more additional process blocks and/or omit one or more of the depicted process blocks. For example, some embodiments of the process 120 may additionally include communicatively coupling the braking assembly to a control sub-system (process block 128) while other embodiments of the process 120 do not. As another example, some embodiments of the process 120 may additionally include communicatively coupling the spooling assembly to a control sub-system (process block 130) while other embodiments of the process 120 do not. As a further example, some embodiments of the process 120 may additionally include connecting a power conduit between a motor and a power sub-system (process block 126) while other embodiments of the process 120 do not.

As another example, some embodiments of the process 120 may additionally include communicatively coupling a power sub-system to a control sub-system (process block 132) while other embodiments of the process 120 do not. As a further example, some embodiments of the process 120 may additionally include communicatively coupling a control sub-system to a sensor (process block 134) while other embodiments of the process 120 do not. Moreover, in other embodiments, one or more of the depicted process blocks may be performed in a different order, for example, such that the spooling assembly is implemented on the equipment frame before the braking assembly is secured to the equipment frame.

In any case, as described above, pipe deployment equipment, such as a pipe deployment trailer 42 or a pipe deployment frame 116, in a pipe deployment system 38 generally includes an equipment frame 66 on which one or more components are secured (e.g., implemented and/or disposed). In particular, as described above, a braking assembly 60 of pipe deployment equipment, which includes at least a brake disc 70, may be secured to the equipment frame 66 of the pipe deployment equipment. As such, implementing the pipe deployment equipment in the pipe deployment system 38 may include securing (e.g., implementing and/or disposing) a braking assembly 60 with a brake disc 70 to its equipment frame 66, for example, directly or indirectly via one or more support arms 118 (process block 122). In particular, to enable tying rotation of the brake disc 70 with rotation of a pipe drum 52 that is loaded on the pipe deployment equipment and, thus, controlling (e.g., slowing and/or stopping) deployment of a pipe segment 20 from the pipe drum 52 using the braking assembly 60, the brake disc 70 in the braking assembly 60 may be rotatably secured (e.g., mounted) on the pipe deployment equipment and include a brake disc shaft socket 76, which is implemented to matingly interlock with a drum shaft 54 of the pipe drum 52.

In addition to a brake disc 70, as described above, in some embodiments, a braking assembly 60 on pipe deployment equipment may include one or more guide plates 72 implemented along the rim of the brake disc 70. In other words, in such embodiments, securing the braking assembly 60 to the equipment frame 66 of the pipe deployment equipment may include implementing one or more guide plates 72 along the rim of the brake disc 70 (process block 136). Additionally, as described above, in some embodiments, a braking assembly 60 on pipe deployment equipment may include one or more brake pads 74 implemented along the rim of its brake disc 70. In other words, in such embodiments, securing the braking assembly 60 to the equipment frame 66 of the pipe deployment equipment may include implementing one or more brake pads 74 along the rim of the brake disc 70 (process block 138).

In addition to pipe deployment equipment, as described above, in some embodiments, a pipe deployment system 38 may include a control sub-system 104, which is implemented and/or operated to generally control operation of the pipe deployment system 38. In particular, in some such embodiments, the control sub-system 104 may generally control operation of a braking assembly 60 of the pipe deployment equipment, for example, at least in part by instructing an actuator in the braking assembly 60 to engage one or more brake pads 74 in the braking assembly 60 with a corresponding brake disc 70 and/or to disengage the one or more brake pads 74 from the brake disc 70 via one or more control signals 114. In other words, in such embodiments, implementing the pipe deployment system 38 may include communicatively coupling the control sub-system 104 to the braking assembly 60 of the pipe deployment equipment (process block 128). In fact, as mentioned above, in some embodiments, a control sub-system 104 in a pipe deployment system 38 may be implemented (e.g., disposed and/or secured) on the equipment frame 66 of pipe deployment equipment in the pipe deployment system 38. However, in other embodiments, a control sub-system 104 of a pipe deployment system 38 may be implemented remote from pipe deployment equipment in the pipe deployment system 38 and, thus, not implemented on the equipment frame 66 of the pipe deployment equipment.

In any case, in addition to a braking assembly 60, to facilitate actively spooling one or more pipe segments 20 onto and/or off of a pipe drum 52 using pipe deployment equipment in a pipe deployment system 38, as described above, the pipe deployment equipment may include a spooling assembly 62. In particular, as described above, the spooling assembly 62 may generally be implemented (e.g., secured and/or disposed) on an equipment frame 66 of the pipe deployment equipment. In other words, implementing the pipe deployment equipment in the pipe deployment system 38 may include implementing (e.g., disposing and/or securing) a spooling assembly 62 on its equipment frame 66 (process block 124).

Additionally, as described above, in some embodiments, a spooling assembly 62 on pipe deployment equipment may include one or more motors 86. In particular, to facilitate controlling spooling of a pipe segment 20 onto and/or off of a pipe drum 52, as described above, the pipe deployment equipment may be implemented to tie rotation of a motor shaft 143 of a motor 86 in the spooling assembly 62 to rotation of the pipe drum 52 loaded on the pipe deployment equipment. Since a brake disc 70 in the braking assembly 60 of the pipe deployment equipment is implemented to have its rotation tied to rotation of a pipe drum 52, to facilitate tying rotation of the motor shaft 143 in the spooling assembly 62 with rotation of the pipe drum 52 with reduced component count, in some embodiments, the spooling assembly 62 may be implemented to tie the rotation of the motor shaft to the rotation of the brake disc 70.

In particular, as described above, to facilitate tying rotation of a motor shaft 143 in the spooling assembly 62 to rotation of a brake disc 70 in the braking assembly 60, in some such embodiments, the motor shaft 143 may be secured (e.g., welded and/or bolted) directly to the brake disc 70. In other words, in such embodiments, implementing the spooling assembly 62 may include securing the motor shaft 143 in the spooling assembly 62 to the brake disc 70 in the braking assembly 60 (process block 140). For example, in some such embodiments, the motor shaft 143 may be secured to the outward-facing surface 98 of the brake disc 70.

However, as described above, to facilitate adjusting spooling speed, in some embodiments, a spooling assembly 62 on pipe deployment equipment may additionally include a gear box 88. In particular, as described above, in some such embodiments, the input (e.g., driven) wheel (e.g., gear) of the gear box 88 may be coupled to the motor shaft 143 of a motor 86 in the spooling assembly 62 to tie rotation of the motor shaft 143 to rotation of the input wheel and, thus, to enable operation of the motor 86 to drive operation of the gear box 88. In other words, in such embodiments, implementing the spooling assembly 62 may include coupling the motor shaft 143 of the motor 86 to the input wheel 103 of the gear box 88 (process block 142).

However, as described above, in other embodiments, operation of a gear box 88 in a spooling assembly 62 may be driven manually (e.g., by an operator or a service technician) or via one or more motors 86 separate (e.g., external) from the spooling assembly 62. To enable operation to be driven manually and/or via an external motor 86, as described above, in some such embodiments, the spooling assembly 62 may additionally include a handle 127, which has a handle bar 129 as well as a handle shaft that extends out from the handle bar 129 and that matingly interlocks with an input wheel 103 of the gear box 88. In other words, in such embodiments, implementing the spooling assembly 62 may include implementing a handle 127 to be secured to the input wheel 103 of its gear box 88 (process block 147). For example, the handle 127 may be implemented such that its handle shaft is keyed with one or more flat outer surfaces.

Moreover, as described above, in other embodiments, a spooling assembly 62 of pipe deployment equipment, such as a pipe deployment trailer 42, may be implemented to enable rotation of a rotation of a trailer axle 69 of the pipe deployment equipment to drive operation of its gear box 88. To enable the trailer axle 69 to drive operation of the gear box 88, in such embodiments, the input wheel 103 of the gear box 88 may be connected to the trailer axle 69. In other words, in such embodiments, implementing the spooling assembly 62 may include connecting the input wheel 103 of its gear box 88 to a trailer axle 69 of the pipe deployment equipment (process block 149). In particular, in some such embodiments, the input wheel 103 of the gear box 88 may be connected directly to the trailer axle 69. However, as described above, in other such embodiments, the input wheel 103 of the gear box 88 may be connected to the trailer axle 69 via an input looped member 94B that is secured around the input wheel 103 and the trailer axle 69, for example, to enable the trailer axle 69 to translationally move slightly relative to the gear box 88.

In any case, to facilitate tying rotation of its input (e.g., drive) wheel 103 to rotation of a brake disc 70 in the braking assembly 60, as described above, in some embodiments, the output (e.g., driven) wheel 92 of the gear box 88 may be secured directly to the brake disc 70. In other words, in such embodiments, implementing the spooling assembly 62 may include securing the output wheel 92 of the gear box 88 to the brake disc 70 (process block 144). Merely as an illustrative non-limiting example, the output wheel 92 may be secured directly to the outward-facing surface 98 of the brake disc 70, for example, when a brake disc shaft socket 76 is implemented on an inward-facing (e.g., opposite) surface 78 of the brake disc 70.

However, as described above, to enable a brake disc 70 on pipe deployment equipment to translationally move slightly (e.g., to facilitate loading a pipe drum 52 onto the pipe deployment equipment), in other embodiments, the output wheel 92 of a gear box 88 in a spooling assembly 62 may not be secured directly to the brake disc 70. Instead, to facilitate tying rotation of the motor shaft of a motor 86 in the spooling assembly 62 to rotation of the brake disc 70, in such embodiments, the spooling assembly 62 may include a brake disc wheel (e.g., gear and/or sprocket) 96 that is secured to the brake disc 70 (e.g., on the outward-facing surface 98 of the brake disc 70) and a looped member 94, such as a belt or chain, that is secured around the brake disc wheel 96 and the output wheel 92 of the gear box 88. In other words, in such embodiments, implementing the spooling assembly 62 may include securing a brake disc wheel 96 to the brake disc 70 (process block 146) and securing a looped member 94 around the brake disc wheel 96 and the output wheel 92 of its gear box 88 (process block 148).

Moreover, as described above, in other embodiments, a spooling assembly 62 of pipe deployment equipment, such as a pipe deployment trailer 42, may be implemented to enable rotation of a rotation of a trailer axle 69 of the pipe deployment equipment to drive rotation of its brake disc wheel 96. To enable the trailer axle 69 to drive rotation of the brake disc wheel 96, in such embodiments, the spooling assembly 62 may include a trailer axle wheel (e.g., gear and/or sprocket) 135, which is implemented to matingly interlock with the trailer axle 69, and a looped member 94, which is secured around the trailer axle wheel 135 and the brake disc wheel 96. In other words, in such embodiments, implementing the spooling assembly 62 may include implementing a trailer axle wheel 135 to be selectively secured to a trailer axle 59 as well as securing a looped member around the trailer axle wheel 135 and the brake disc wheel 96 (process block 151). In particular, as described above, in some such embodiments, the trailer axle 69 may be implemented such that an outer end is keyed with one or more flat outer surface 137 while the trailer axle wheel 135 is implemented with an axle socket 139 that is keyed with one or more corresponding flat inner surfaces 141. However, in other such embodiments, the trailer axle wheel 135 may by implemented to include a plug that is keyed with one or more flat outer surfaces while the outer end of the trailer axle 69 is implemented to include a plug socket that is keyed with one or more flat inner surfaces.

In any case, as described above, in some embodiments, a pipe deployment system 38 may include a control sub-system 104, which is implemented and/or operated to generally control operation of the pipe deployment system 38. In particular, in some such embodiments, the control sub-system 104 may generally control operation of a spooling assembly 62 on pipe deployment equipment in the pipe deployment system 38, for example, at least in part by instructing an actuator in the spooling assembly 62 to change an intermediate gear 109 that is coupled between the input wheel and the output wheel 92 of a gear box 88 in the spooling assembly 62. In other words, in such embodiments, implementing the pipe deployment system 38 may include communicatively coupling the control sub-system 104 to the spooling assembly 62 of the pipe deployment equipment (process block 130).

To facilitate driving (e.g., powering) operation of a spooling assembly 62 on pipe deployment equipment, as described above, in some embodiments, a pipe deployment system 38 may additionally include a power sub-system 100, which is connected to one or more motors 86 via one or more power conduits 102. As such, implementing the pipe deployment system 38 may additionally include connecting one or more power conduits 102 between the power sub-system 100 and one or more motors 86 (process block 126). For example, when the power sub-system 100 includes a fluid source and a motor 86 is a fluid (e.g., hydraulic and/or pneumatic) motor, one or more fluid conduits may be connected therebetween. Additionally or alternatively, when the power sub-system 100 includes an electrical power source and a motor 86 is an electric motor, one or more electrical power conduits, such as a wire or a cable, may be connected therebetween. In fact, to facilitate moving the power sub-system 100 along with the spooling assembly 62, in some embodiments, the power sub-system 100 may be implemented (e.g., disposed and/or secured) on the equipment frame 66 of the pipe deployment equipment.

In any case, as described above, in some embodiments, a motor 86 that drives operation of a spooling assembly 62 may be included in the spooling assembly 62. In other words, in such embodiments, connecting a power conduit 102 may include connecting the power conduit 102 between the spooling assembly 62 and the power sub-system 100. However, as described above, in other embodiments, a motor 86 that drives operation of a spooling assembly 62 may be separate from the spooling assembly 62, for example, in a pipe handler 113. In other words, in some such embodiments, connecting a power conduit 102 may include connecting the power conduit 102 between the power sub-system 100 and a pipe handler 113.

In any case, as described above, in some embodiments, a pipe deployment system 38 may include a control sub-system 104, which is implemented and/or operated to generally control operation of the pipe deployment system 38. In particular, in some such embodiments, the control sub-system 104 may generally control operation of a power sub-system 100 in the pipe deployment system 38, for example, at least in part by instructing the power sub-system 100 to supply or to cease supplying power (e.g., electrical power and/or pressurized fluid) to a motor 86 in the pipe deployment system 38. In other words, in such embodiments, implementing the pipe deployment system 38 may include communicatively coupling the control sub-system 104 to the power sub-system 100 (process block 132).

To facilitate improving operation of a pipe deployment system 38, as described above, in some embodiments, a control sub-system 104 may control operation of the pipe deployment system 38 based at least in part on sensor data determined by one or more sensors 106 in the pipe deployment system 38, for example, in addition to one or more user input. In particular, as described above, in such embodiments, the sensor data may be indicative of one or more operational parameters of the pipe deployment system 38, such as tension exerted on a pipe segment 20 being spooled by the pipe deployment system 38 and/or fluid pressure flowing between a power sub-system 100 and a motor 86 in the pipe deployment system 38, and communicated to the control sub-system 104 via one or more sensor signals 107. In other words, in such embodiments, implementing the pipe deployment system 38 may include communicatively coupling the control sub-system 104 to one or more sensors 106 (process block 134). In fact, as will be described in more detail below, in some such embodiments, the control sub-system 104 may autonomously control operation of the pipe deployment system 38 based at least in part on sensor data determined by the one or more sensors 106. In any case, in this manner, a pipe deployment system 38 including pipe deployment equipment, such as a pipe deployment trailer 42 and/or a pipe deployment frame 116, may be implemented to enable the pipe deployment equipment to operate to facilitate deploying (e.g., laying) a pipe segment 20 into a pipeline system 10 as well as actively spooling (e.g., unspooling and/or respooling) the pipe segment 20 onto and/or off of a pipe drum 52, which, at least in some instances, may facilitate improving deployment efficiency of the pipeline system 10, for example, by obviating separate spooling equipment and, thus, transfer of the pipe drum 52 between the deployment equipment and the separate spooling equipment.

Figure 16:
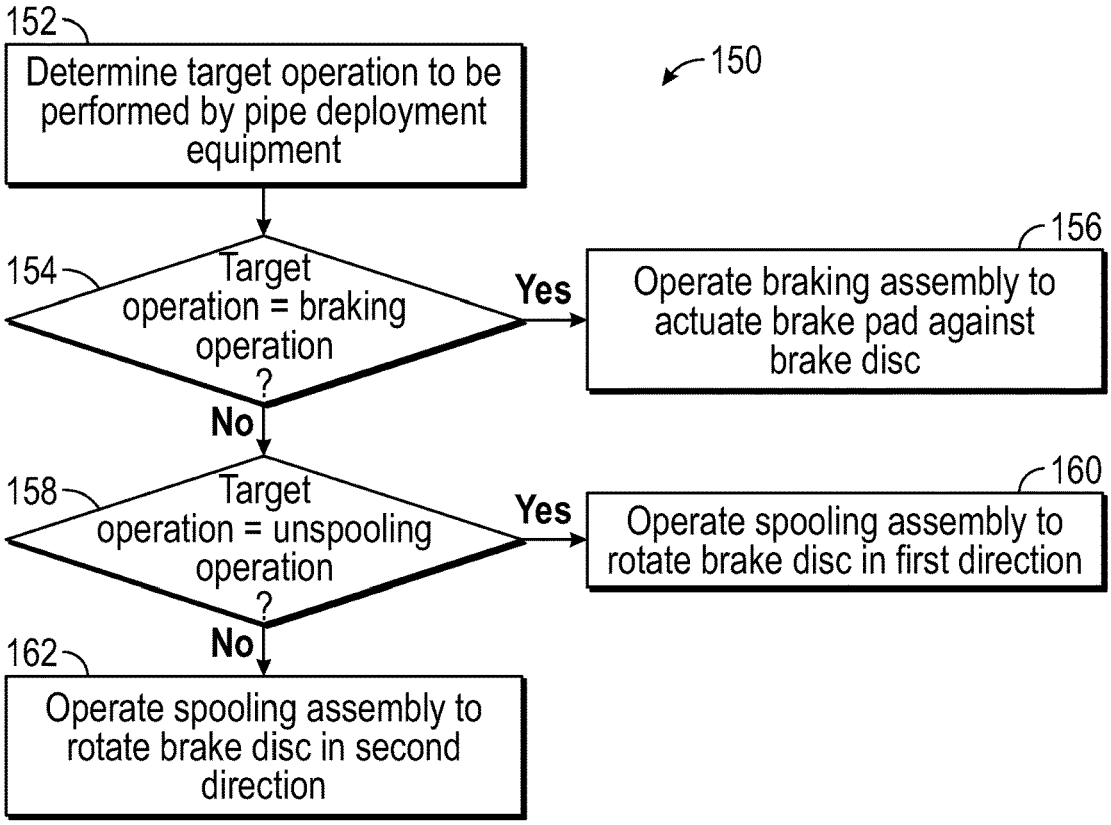
FIG. 16 is flow diagram of an example of a process for operating a pipe deployment system that includes pipe deployment equipment, in accordance with an embodiment of the present disclosure.

To help further illustrate, an example of a process 150 for operating a pipe deployment system 38 that includes pipe deployment equipment, such as a pipe deployment trailer 42 and/or a pipe deployment frame 116, is described in FIG. 16. Generally, the process 150 includes determining a target operation to be performed by pipe deployment equipment (process block 152), determining whether the target operation is a braking operation (decision block 154), and operating a braking assembly to actuate a brake pad against a brake disc when the target operation is a braking operation (process block 156). Additionally, when the target operation in not a braking operation, the process 150 generally includes determining whether the target operation is an unspooling operation (decision block 158), operating a spooling assembly to actuate the brake disc in a first direction when the target operation is an unspooling operation (process block 160), and operating the spooling assembly to actuate the brake disc in a second direction when the target operation is not an unspooling operation (process block 162).

Although described in a specific order, which corresponds with an embodiment of the present disclosure, it should be appreciated that the example process 150 is merely intended to be illustrative and not limiting. In particular, in other embodiments, a process 150 for operating a pipe deployment system 38 may include one or more additional process blocks and/or omit one or more of the depicted process blocks. Additionally or alternatively, in other embodiments, one or more of the depicted process blocks may be performed in a different order, for example, such that whether the target operation is an unspooling operation is determined before determining whether the target operation is a braking operation. Moreover, in some embodiments, the process 150 may be performed at least in part by executing instructions stored in a tangible, non-transitory, computer-readable medium, such as memory 110 in a control sub-system 104, using processing circuitry, such as a processor 108 in the control sub-system 104.

For example, to facilitate controlling operation of pipe deployment equipment in a pipe deployment system 38, in such embodiments, a control sub-system 104 in the pipe deployment system 38 may determine a target operation to be performed by the pipe deployment equipment (process block 152). In particular, in some such embodiments, the control sub-system 104 may determine the target operation to be performed based at least in part on one or more user inputs, for example, which are received via its I/O devices 112. Additionally or alternatively, the control sub-system 104 may autonomously determine the target operation to be performed, for example, based at least in part on one or more operational parameters of the pipe deployment equipment. Merely as an illustrative non-limiting example, the control sub-system 104 may determine that a braking operation should be performed when rotational speed of a brake disc 70 of the pipe deployment equipment and, thus, a pipe drum 52 secured to the brake disc 70 is above a threshold speed. Nevertheless, in other embodiments, operation of the pipe deployment equipment may be manually controlled by a user, such an operator and/or a service technician.

After the control sub-system 104 determines the target operation to be performed by the pipe deployment equipment, the control sub-system 104 may determine whether the target operation is a braking operation (decision block 154). Additionally, when the target operation is a braking operation, a braking assembly 60 of the pipe deployment equipment may be operated to actuate one or more brake pads 74 against a corresponding brake disc 70 in the braking assembly 60, thereby slowing or stopping rotation of the brake disc 70 and, thus, a pipe drum 52 secured to the brake disc 70 (process block 156). In particular, in some embodiments, the control sub-system 104 may instruct one or more actuators in the braking assembly 60 to actuate corresponding brake pads 74 against the brake disc 70, for example, via one or more control signals 114.

On the other hand, when the target operation to be performed by the pipe deployment equipment is not a braking operation, the control sub-system 104 may determine whether the target operation is an unspooling operation during which a pipe segment 20 is to be unspooled off of a pipe drum 52 (decision block 158). As described above, rotation of a brake disc 70 in a braking assembly 60 on pipe deployment equipment may be tied to rotation of a pipe drum 52 that is secured thereto. Additionally, as described above, in some embodiments, rotation of a motor shaft 143 in or connected to a spooling assembly 62 of the pipe deployment equipment may be tied to rotation of the brake disc 70 directly or indirectly, for example, via a gear box 88 and/or a looped member 94.

Thus, when the target operation is an unspooling operation, the pipe deployment equipment may be operated to rotate (e.g., actuate) the brake disc 70 in its braking assembly 60 in a first direction (process block 160). In particular, to facilitate rotating the brake disc 70 in the first direction, in some embodiments, the control sub-system 104 may instruct a power sub-system 100 in the pipe deployment system 38 to supply power (e.g., electrical power and/or pressurized fluid) to a motor 86 in or connected to the spooling assembly 62 in a first manner that corresponds with the first rotational direction of the brake disc 70, for example, via one or more control signals 114. Merely as an illustrative non-limiting example, to facilitate rotating the brake disc 70 in the first direction, when the motor 86 is a fluid (e.g., hydraulic and/or pneumatic) motor, the control sub-system 104 may instruct the power sub-system 100 to supply (e.g., inject) fluid to the motor 86. Additionally, to facilitate rotating the brake disc 70 in the first direction, when the motor 86 is an electric motor, the control sub-system 104 may instruct the power sub-system 100 to supply electrical power with a first (e.g., positive) polarity to the motor 86.

On the other hand, when the target operation is not an unspooling operation, the control sub-system 104 may determine that the target operation is spooling (e.g., respooling) operation during which a pipe segment 20 is to be spooled onto a pipe drum 52. Thus, when the target operation is not an unspooling operation, the pipe deployment equipment may be operated to rotate (e.g., actuate) the brake disc 70 in its braking assembly 60 in a second (e.g., opposite) direction (process block 162). In particular, to facilitate rotating the brake disc 70 in the second direction, in some embodiments, the control sub-system 104 may instruct a power sub-system 100 in the pipe deployment system 38 to supply power (e.g., electrical power and/or pressurized fluid) to a motor 86 in or connected to the spooling assembly 62 in a second (e.g., different) manner that corresponds with the second rotational direction of the brake disc 70, for example, via one or more control signals 114. Merely as an illustrative non-limiting example, to facilitate rotating the brake disc 70 in the second direction, when the motor 86 is a fluid (e.g., hydraulic and/or pneumatic) motor, the control sub-system 104 may instruct the power sub-system 100 to extract fluid from the motor 86. Additionally, to facilitate rotating the brake disc 70 in the second direction, when the motor 86 is an electric motor, the control sub-system 104 may instruct the power sub-system 100 to supply electrical power with a second (e.g., negative and/or opposite) polarity to the motor 86.

In any case, in this manner, pipe deployment equipment, such as a pipe deployment trailer 42 and/or a pipe deployment frame 116, in a pipe deployment system 38 may be operated to facilitate deploying a pipe segment 20 into a pipeline system 10 as well as actively spooling (e.g., unspooling and/or respooling) the pipe segment 20 onto and/or off of a pipe drum 52. As described above, at least in some instances, operating the pipe deployment equipment to deploy the pipe segment 20 as well as to actively spool the pipe segment 20 may facilitate improving deployment efficiency of the pipeline system 10, for example, by obviating separate spooling equipment and, thus, transfer of the pipe drum 52 between the deployment equipment and the separate spooling equipment. In fact, as mentioned above, to facilitate further improving deployment efficiency, in some embodiments, a spooling (e.g., unspooling and/or respooling) operation performed by pipe deployment equipment may be autonomously controlled by a corresponding control sub-system 104, for example, with little or no user intervention.

Figure 17:
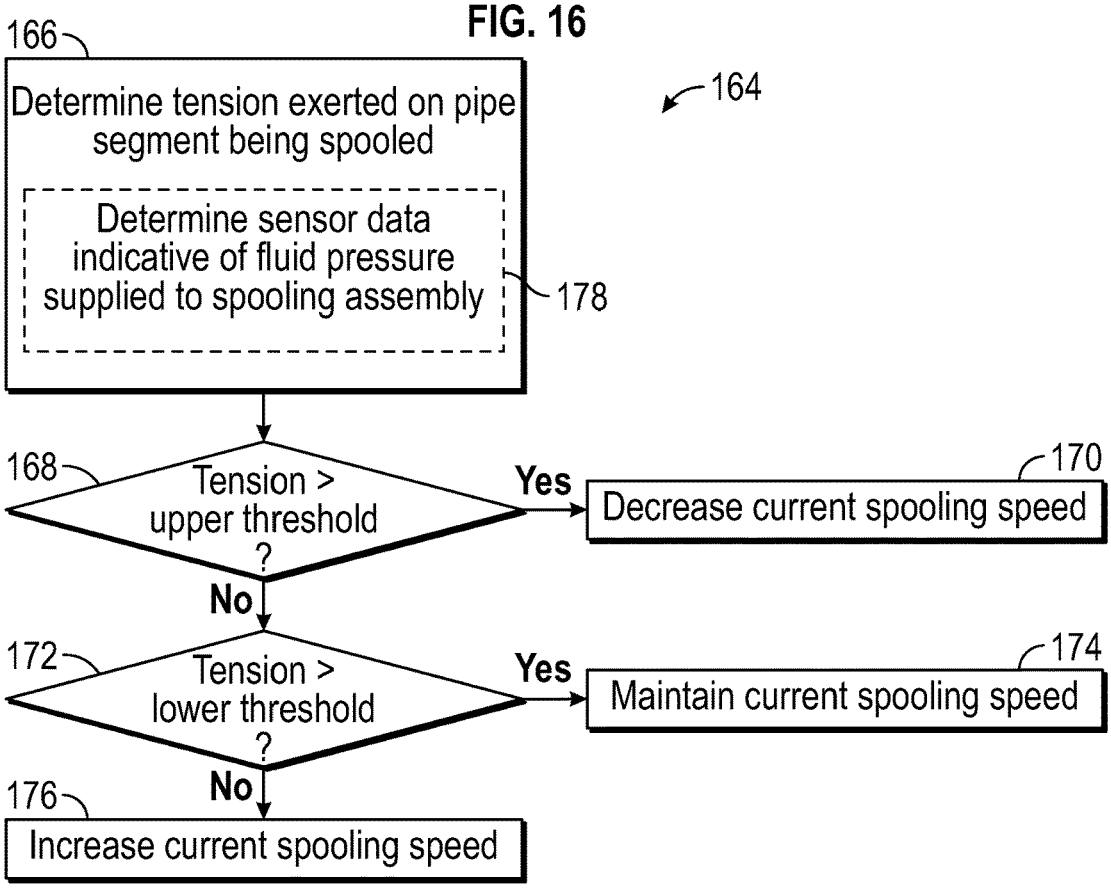
FIG. 17 is flow diagram of an example of a process for autonomously controlling spooling (e.g., unspooling and/or respooling) of a pipe segment, in accordance with an embodiment of the present disclosure.

To help illustrate, an example of a process 164 for controlling performance of a spooling (e.g., unspooling and/or respooling) operation is described in FIG. 17. Generally, the process 164 includes determining tension exerted on a pipe segment being spooled (process block 166), determining whether the tension is greater than an upper tension threshold (decision block 168), and decreasing current spooling speed when the tension is greater than the upper tension threshold (process block 170). Additionally, when the tension is not greater than the upper tension threshold, the process 164 generally includes determining whether the tension is greater than a lower tension threshold (decision block 172), maintaining the current spooling speed when the tension is greater than the lower tension threshold (process block 174), and increasing the current spooling speed when the tension is not greater than the lower tension threshold (process block 176).

Although described in a specific order, which corresponds with an embodiment of the present disclosure, it should be appreciated that the example process 164 is merely intended to be illustrative and not limiting. In particular, in other embodiments, a process 164 for controlling performance of a spooling (e.g., unspooling and/or respooling) operation may include one or more additional process blocks and/or omit one or more of the depicted process blocks. Additionally or alternatively, in other embodiments, one or more of the depicted process blocks may be performed in a different order, for example, such that whether the tension is greater than the lower tension threshold is determined before determining whether the tension is greater than the upper threshold. Moreover, in some embodiments, the process 164 may be performed at least in part by executing instructions stored in a tangible, non-transitory, computer-readable medium, such as memory 110 in a control sub-system 104, using processing circuitry, such as a processor 108 in the control sub-system 104.

For example, in such embodiments, a control sub-system 104 in a pipe deployment system 38 may determine the tension being exerted on a pipe segment 20 that is being spooled (e.g., unspooled and/or respooled) by pipe deployment equipment in the pipe deployment system 38 (process block 166). In particular, at least in some such embodiments, the control sub-system 104 may determine the tension being exerted on the pipe segment 20 based at least in part on sensor data determine by one or more sensors 106 in the pipe deployment system 38. For example, the control sub-system 104 may determine the tension being exerted on the pipe segment 20 based at least in part on sensor data determined by a tension sensor 106 and/or a torque sensor 106.

However, as described above, in some embodiments, fluid pressure flowing between a power sub-system 100 in a pipe deployment system 38 and a motor 86 in or connected to a spooling assembly 62 on pipe deployment equipment, which is operated to spool a pipe segment 20, may be indicative of the tension the spooling causes on the pipe segment 20. In other words, to facilitate determining the tension being exerted on the pipe segment 20, in some such embodiments, the control sub-system 104 may determine sensor data that is determined by a pressure sensor to be indicative of fluid pressure flowing between the power sub-system 100 and the motor 86 (process block 178). In particular, in such embodiments, the control sub-system 104 may process the fluid pressure sensor data to determine the tension being exerted on the pipe segment 20 based at least in part on a relationship between fluid pressure and resulting tension, for example, which is predetermined and stored in memory 110 of the control sub-system 104.

In any case, to facilitate optimizing spooling speed (e.g., balancing spooling efficiency and likelihood structural integrity being compromised) provided by the pipe deployment equipment, the control sub-system 104 may compare the tension being exerted on the pipe segment 20 against one or more tension thresholds. In particular, in some embodiments, the one or more tension thresholds may be predetermined and saved in memory 110 of the control sub-system 104. Additionally, in some embodiments, the one or more tension thresholds may include an upper tension threshold and a lower tension threshold.

In other words, to facilitate optimizing spooling speed provided by the pipe deployment equipment, in such embodiments, the control sub-system 104 may determine (e.g., retrieve and/or receive) the upper tension threshold, for example, from memory 110 in the control sub-system 104. The control sub-system 104 may then compare the upper tension threshold against the tension exerted on the pipe segment 20 that is being spooled by the pipe deployment equipment. In particular, as in the depicted example, in some embodiments, the control sub-system 104 may determine whether the tension being exerted on the pipe segment 20 is greater than the upper tension threshold (decision block 168).

To facilitate reducing the likelihood that spooling by the pipe deployment equipment inadvertently compromises structural integrity of the pipe segment 20, when the tension being exerted thereon is greater than the upper tension threshold, the control sub-system 104 may instruct the pipe deployment system 38 to decrease (e.g., reduce) rotational speed of a motor shaft 143 in or connected to the spooling assembly and, thus, a current spooling speed provided by the pipe deployment equipment, for example, via one or more control signals 114 (process block 170). Merely as an illustrative non-limiting example, to facilitate reducing spooling speed, the control sub-system 104 may instruct the power sub-system 100 to reduce power (e.g., electrical power and/or pressurized fluid) that is supplied to a corresponding motor 86. Additionally or alternatively, to facilitate reducing spooling speed, the control sub-system 104 may instruct the spooling assembly 62 to connect a larger diameter (e.g., lower) intermediate gear or a neutral intermediate gear between the input wheel and the output wheel 92 of a gear box 88 in the spooling assembly 62. Furthermore, to facilitate reducing spooling speed, the control sub-system 104 may additionally or alternatively instruct a braking assembly 60 of the pipe deployment equipment to actuate one or more brake pads 74 against a corresponding brake disc 70 that is secured to a pipe drum 52 on to and/or off of which the pipe segment 20 is being spooled.

However, as mentioned above, in some embodiments, brake pads 74 in a braking assembly 60 of pipe deployment equipment may be obviated by a spooling assembly 62 of the pipe deployment equipment and, thus, not included in the braking assembly 60. Instead, in some such embodiments, rotation of a brake disc 70 in the braking assembly 60 and, thus, rotation of the pipe drum 52 matingly interlocked therewith may be slowed at least in part by switching out a current intermediate gear in a gear box 88 of the spooling assembly 62 for a larger diameter intermediate gear or a neutral intermediate gear. Additionally or alternatively, in some such embodiments, rotation of a brake disc 70 in the braking assembly 60 and, thus, rotation of the pipe drum 52 matingly interlocked therewith may be slowed or even stopped at least in part by operating a motor 86 in or connected to the spooling assembly 62 to act against the rotation of the brake disc 70.

In any case, as described above, in some embodiments, a pipe deployment system 38 may include a lower tension threshold in addition to an upper tension threshold. Thus, to facilitate optimizing spooling speed provided by the pipe deployment equipment, in such embodiments, the control sub-system 104 may determine (e.g., retrieve and/or receive) the lower tension threshold and compare the lower tension threshold against the tension that is being exerted on the pipe segment 20, for example, when the tension being exerted on the pipe segment 20 is not greater than the upper tension threshold. In particular, as in the depicted example, in some such embodiments, the control sub-system 104 may determine whether the tension being exerted on the pipe segment 20 is greater than the lower tension threshold (decision block 172).

To facilitate reducing spooling duration and, thus, improving spooling efficiency provided by the pipe deployment equipment, when the tension being exerted on the pipe segment 20 not greater than the lower tension threshold, the control sub-system 104 may instruct the pipe deployment system 38 to increase rotational speed of a motor shaft 143 that is in or connected to the spooling assembly 62 of the pipe deployment equipment and, thus, a current spooling speed provided by the pipe deployment equipment, for example, via one or more control signals 114 (process block 176). Merely as an illustrative non-limiting example, to facilitate increasing spooling speed, the control sub-system 104 may instruct the power sub-system 100 to increase power (e.g., electrical power and/or pressurized fluid) that is supplied to a corresponding motor 86. Additionally or alternatively, to facilitate increasing spooling speed, the control sub-system 104 may instruct the spooling assembly 62 to connect a smaller diameter (e.g., higher) intermediate gear between the input gear and the output gear 92 of a gear box 88 in the spooling assembly 62. Furthermore, to facilitate increasing spooling speed, the control sub-system 104 may additionally instruct a braking assembly 60 of the pipe deployment equipment to maintain its one or more brake pads 74 disengaged from a corresponding brake disc 70.

On the other hand, when the tension being exerted on the pipe segment 20 is greater than the lower tension threshold and not greater than the upper tension threshold, the control sub-system 104 may determine that the current spooling speed provided by the pipe deployment equipment is properly optimized, for example, to balance spooling efficiency and likelihood of spooling inadvertently compromising structural integrity of the pipe segment 20. Thus, in such instances, the control sub-system 104 may instruct the pipe deployment system 38 to maintain the current spooling speed, for example, via one or more control signals 114 (process block 174). Merely as an illustrative non-limiting example, to facilitate maintaining spooling speed, the control sub-system 104 may instruct the power sub-system 100 to continue supplying the same amount of power (e.g., electrical power and/or pressurized fluid) to a corresponding motor 86. Additionally or alternatively, to facilitate maintaining spooling speed, the control sub-system 104 may instruct the spooling assembly 62 to maintain a current intermediate gear connected between the input gear and the output gear 92 of a gear box 88 in the spooling assembly 62. Furthermore, to facilitate maintaining the current spooling speed, the control sub-system 104 may additionally instruct a braking assembly 60 of the pipe deployment equipment to maintain its one or more brake pads 74 disengaged from a corresponding brake disc 70. In this manner, the present disclosure provides techniques for implementing and/or operating pipe deployment equipment, such as a pipe deployment trailer or a pipe deployment frame, to facilitate deploying one or more pipe segments in a pipeline system as well as actively spooling (e.g., unspooling and/or respooling) the one or more pipe segments onto and/or off from a corresponding pipe drum, which, at least in some instances, may facilitate improving deployment efficiency of the pipeline system, for example, by obviating separate spooling equipment and, thus, thus transfer of the pipe drum between the spooling equipment and the pipe deployment equipment While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed is:

1. A system comprising:

a pipe drum, wherein the pipe drum comprises a drum shaft and a drum body configured to enable a pipe segment comprising tubing that defines a pipe bore and a fluid conduit within an annulus of the tubing to be spooled on the pipe drum; and pipe deployment equipment on which the pipe drum is configured to be loaded, wherein the pipe deployment equipment comprises:

a brake disc, wherein the brake disc comprises a shaft socket that is keyed to matingly interlock with the drum shaft of the pipe drum to facilitate tying rotation of the pipe drum with rotation of the brake disc; and a spooling assembly comprising:

a motor with a motor shaft, wherein the spooling assembly is configured to tie rotation of the motor shaft with the rotation of the brake disc to enable the pipe deployment equipment to actively rotate the brake disc in a first direction to facilitate spooling the pipe segment off of the pipe drum, to actively rotate the brake disc in a second direction to facilitate spooling the pipe segment onto the pipe drum, or both; and a gear box, wherein the gear box comprises:

an input wheel connected to the motor shaft of the motor;

an output wheel, wherein rotation of the output wheel is configured to be tied to the rotation of the brake disc; and a plurality of intermediate gears that are selectively connected between the input wheel and the output wheel of the gear box.

2. The system of claim 1, wherein the spooling assembly of the pipe deployment equipment comprises:

a disc wheel secured directly to the brake disc; and a looped member secured around the output wheel of the gear box and the disc wheel secured to the brake disc.

3. The system of claim 1, wherein the pipe deployment equipment comprises a brake pad that is implemented proximate to the brake disc of the pipe deployment equipment, wherein the pipe deployment equipment is configured to actuate the brake pad against the brake disc to facilitate resisting rotation of the pipe drum that is matingly interlocked with the brake disc.

4. The system of claim 1, wherein the pipe deployment equipment comprises a pipe deployment trailer that comprises:

an equipment frame, wherein the brake disc and the spooling assembly are secured to the equipment frame;

one or more trailer wheels secured to the equipment frame; and a tongue assembly secured to the equipment frame, wherein the tongue assembly of the pipe deployment trailer is configured to be secured to a hitch assembly on a tow vehicle to enable the tow vehicle to tow the pipe deployment trailer.

5. The system of claim 4, wherein the pipe deployment trailer comprises a lifting assembly secured to the equipment frame of the pipe deployment trailer, wherein the lifting assembly is configured to lift the pipe drum such that the drum shaft of the pipe drum matingly interlocks with the shaft socket on the brake disc, lower the pipe drum such that the drum shaft of the pipe drum disengages from the shaft socket on the brake disc, or both.

6. The system of claim 1, comprising:

a sensor configured to determine sensor data indicative of one or more operational parameters of the pipe deployment equipment; and a control sub-system communicatively coupled to the sensor, wherein the control sub-system is configured to control operation of the pipe deployment equipment based at least in part on the sensor data determined by the sensor.

7. The system of claim 6, comprising:

a power sub-system communicatively coupled to the control sub-system; and one or more power conduits coupled between the power sub-system and the spooling assembly of the pipe deployment equipment, wherein the control sub-system is configured to instruct the power sub-system to supply power to the motor in the spooling assembly that causes the pipe drum that is matingly interlocked with the brake disc of the pipe deployment equipment to rotate in the first direction to facilitate spooling the pipe segment off of the pipe drum or in the second direction to facilitate spooling the pipe segment onto the pipe drum.

8. A method of operating pipe deployment equipment in a pipe deployment system comprising:

determining, using a control sub-system of the pipe deployment system, a target operation to be performed by the pipe deployment equipment, wherein a pipe drum and a pipe segment spooled on the pipe drum are loaded on the pipe deployment equipment;

instructing, using the control sub-system, a braking assembly of the pipe deployment equipment to actuate a brake pad against a brake disc that is matingly interlocked with the pipe drum to facilitate slowing deployment of the pipe segment from the pipe deployment equipment in response to determining that the target operation to be performed by the pipe deployment equipment is a braking operation; and in response to determining that the target operation to be performed by the pipe deployment equipment is a pipe spooling operation:

instructing, using the control sub-system, a power sub-system in the pipe deployment system to supply power to a spooling assembly of the pipe deployment equipment to enable the pipe deployment equipment to actively rotate the brake disc of the braking assembly in a first direction to facilitate spooling the pipe segment off of the pipe drum that is matingly interlocked with the brake disc or to actively rotate the brake disc of the braking assembly in a second direction to facilitate spooling the pipe segment onto the pipe drum that is matingly interlocked with the brake disc;

determining, using the control sub-system, tension exerted on the pipe segment due to the pipe segment being actively spooled by the pipe deployment equipment;

instructing, using the control sub-system, the pipe deployment equipment to connect a first intermediate gear that has a larger diameter between an input wheel and an output wheel of a gear box in the spooling assembly of the pipe deployment equipment in response to determining that the tension being exerted on the pipe segment due to spooling by the pipe deployment equipment is greater than an upper tension threshold;

instructing, using the control sub-system, the pipe deployment equipment to connect a second intermediate gear that has a smaller diameter between the input wheel and the output wheel of the gear box in the spooling assembly of the pipe deployment equipment in response to determining that the tension being exerted on the pipe segment due to spooling by the pipe deployment equipment is not greater than a lower tension threshold; and instructing, using the control sub-system, the pipe deployment equipment to maintain a current intermediate gear connected between the input wheel and the output wheel of the gear box in the spooling assembly of the pipe deployment equipment in response to determining that the tension being exerted on the pipe segment due to spooling by the pipe deployment equipment is greater than the lower tension threshold and not greater than the upper tension threshold.

9. The method of claim 8, comprising determining, using the control sub-system, whether the target operation to be performed by the pipe deployment equipment is an unspooling operation in response to determining that the target operation is not the braking operation, wherein instructing the power sub-system to supply power to the spooling assembly of the pipe deployment system comprises:

instructing the power sub-system to supply fluid to a motor in the spooling assembly of the pipe deployment equipment to facilitate activity rotating the brake disc of the braking assembly in the first direction such that the pipe segment is spooled off of the pipe drum that is matingly interlocked with the brake disc in response to determining that the target operation to be performed by the pipe deployment equipment is the unspooling operation; and instructing the power sub-system to extract fluid from the motor in the spooling assembly of the pipe deployment equipment to facilitate actively rotating the brake disc of the braking assembly in the second direction such that the pipe segment is spooled onto the pipe drum that is matingly interlocked with the brake disc in response to determining that the target operation to be performed by the pipe deployment equipment is not the unspooling operation.

10. The method of claim 8, comprising determining, using the control sub-system, whether the target operation to be performed by the pipe deployment equipment is an unspooling operation in response to determining that the target operation is not the braking operation, wherein instructing the power sub-system in the pipe deployment system to supply power to the spooling assembly of the pipe deployment system comprises:

instructing the power sub-system to supply electrical power with a first polarity to a motor in the spooling assembly of the pipe deployment equipment to enable the pipe deployment equipment to actively rotate the brake disc of the braking assembly in the first direction such that the pipe segment is spooled off of the pipe drum that is matingly interlocked with the brake disc in response to determining that the target operation to be performed by the pipe deployment equipment is the unspooling operation; and instructing the power sub-system to supply electrical power with a second polarity to the motor in the spooling assembly of the pipe deployment equipment to enable the pipe deployment equipment to actively rotate the brake disc of the braking assembly in the second direction such that the pipe segment is spooled onto the pipe drum that is matingly interlocked with the brake disc in response to determining that the target operation to be performed by the pipe deployment equipment is not the unspooling operation.

11. The method of claim 8, wherein instructing the power sub-system to supply power to the spooling assembly of the pipe deployment equipment comprises:

instructing the power sub-system to decrease the power supplied to a motor in the spooling assembly of the pipe deployment equipment in response to determining that the tension being exerted on the pipe segment due to spooling by the pipe deployment equipment is greater than the upper tension threshold;

instructing the power sub-system to increase the power supplied to the motor in the spooling assembly of the pipe deployment equipment in response to determining that the tension being exerted on the pipe segment due to spooling by the pipe deployment equipment is not greater than the lower tension threshold; and instructing the power sub-system to maintain the power supplied to the motor in the spooling assembly of the pipe deployment equipment constant in response to determining that the tension being exerted on the pipe segment due to spooling by the pipe deployment equipment is greater than the lower tension threshold and not greater than the upper tension threshold.

12. The method of claim 8, wherein determining the tension exerted on the pipe segment due to being actively spooled by the pipe deployment equipment comprises:

receiving sensor data from a pressure sensor that is indicative of fluid pressure flowing between the power sub-system and a motor in the spooling assembly of the pipe deployment equipment; and processing the sensor data received from the pressure sensor based at least in part on a relationship between the fluid pressure and resulting tension to determine the tension exerted on the pipe segment due to being actively spooled by the pipe deployment equipment.

13. The method of claim 8, comprising, in response to determining that the target operation to be performed by the pipe deployment equipment is a pipe spooling operation:

instructing, using the control sub-system, the braking assembly of the pipe deployment equipment to actuate the brake pad against the brake disc that is matingly interlocked with the pipe drum in response to determining that the tension being exerted on the pipe segment due to spooling by the pipe deployment equipment is greater than a tension threshold; and instructing, using the control sub-system, the braking assembly of the pipe deployment equipment to maintain the brake pad disengaged from the brake disc in response to determining that the tension being exerted on the pipe segment due to spooling by the pipe deployment equipment is not greater than the tension threshold.

14. The method of claim 8, wherein the pipe deployment equipment comprises a pipe deployment trailer.

15. A pipe deployment system comprising a pipe deployment trailer, wherein the pipe deployment trailer comprises:

an equipment frame;

one or more wheels secured to the equipment frame to enable the pipe deployment trailer to be moved by a vehicle in the pipe deployment system;

a braking assembly secured to the equipment frame, wherein the braking assembly comprises a brake disc configured to matingly interlock with a pipe drum that is to be loaded on the pipe deployment trailer to facilitate tying rotation of the brake disc with rotation of the pipe drum; and a spooling assembly comprising a motor, wherein the spooling assembly is configured to tie rotation of a motor shaft of the motor to the rotation of the brake disc in the braking assembly to enable the pipe deployment trailer to:

actively rotate the brake disc in a first direction to facilitate spooling a pipe segment off of the pipe drum that is matingly interlocked with the brake disc;

actively rotate the brake disc in a second direction to facilitate spooling the pipe segment onto the pipe drum that is matingly interlocked with the brake disc; or both;

a lifting assembly secured to the equipment frame, wherein the lifting assembly is configured to lift the pipe drum to facilitate matingly interlocking a drum shaft of the pipe drum with a shaft socket of the brake disc, lower the pipe drum to facilitate disengaging the drum shaft of the pipe drum from the shaft socket of the brake disc, or both; and a tongue assembly secured to the equipment frame, wherein the tongue assembly is configured to interlock with a hitch assembly of the vehicle in the pipe deployment system to enable the vehicle to tow the pipe deployment trailer.

16. The pipe deployment system of claim 15, comprising a power sub-system that is secured to the equipment frame of the pipe deployment trailer and connected to the motor in the spooling assembly of the pipe deployment trailer via one or more power conduits, wherein the power sub-system is configured to selectively power operation of the motor in the spooling assembly to enable the pipe deployment trailer to actively drive rotation of the brake disc in the braking assembly.

17. The pipe deployment system of claim 15, wherein the pipe deployment trailer is configured to actively slow or stop the rotation of the pipe drum that is matingly interlocked with the brake disc in the braking assembly of the pipe deployment trailer at least in part by operating the motor in the spooling assembly of the pipe deployment trailer to act against the rotation of the brake disc.

* * * * *